US009452344B2

(12) United States Patent
Ritter

(10) Patent No.: US 9,452,344 B2
(45) Date of Patent: Sep. 27, 2016

(54) PUCK SYSTEM

(71) Applicant: William J Ritter, Bozeman, MT (US)

(72) Inventor: William J Ritter, Bozeman, MT (US)

( * ) Notice: Subject to any disclaimer, the term of this patent is extended or adjusted under 35 U.S.C. 154(b) by 0 days.

(21) Appl. No.: 14/981,777

(22) Filed: Dec. 28, 2015

(65) Prior Publication Data

US 2016/0175690 A1 Jun. 23, 2016

Related U.S. Application Data

(60) Provisional application No. 62/099,364, filed on Jan. 2, 2015.

(51) Int. Cl.
*A63C 10/14* (2012.01)
*A63C 10/16* (2012.01)

(52) U.S. Cl.
CPC ..... *A63C 10/14* (2013.01); *A63C 10/16* (2013.01)

(58) Field of Classification Search
CPC ..... A60C 10/16; A60C 10/14
See application file for complete search history.

(56) References Cited

U.S. PATENT DOCUMENTS 3,298,365 A * 1/1967 Lewis ..... A61F 5/0111 602/27
5,049,079 A * 9/1991 Furtado ..... A63B 69/18 434/253
2015/0175690 A1* 6/2015 Hoffman ..... C07K 16/241 424/142.1

* cited by examiner

*Primary Examiner* — John Walters
*Assistant Examiner* — James Triggs
(74) *Attorney, Agent, or Firm* — Kal K Lambert; Lambert Patent Services

(57) ABSTRACT

A puck system achieves adjustable stance in three degrees of freedom—foot placement, foot angulation, and crosswise centering—on a snow gliding board. The puck system includes pairs of puck assemblies for each rider's foot. Puck assemblies are formed from a sliderblock, a flanged disk, and fasteners for each puck. To achieve crosswise centering, the sliderblock is patterned on a top face so as to engage a detent on the underside of the flanged disk in one of many crosswise positions. In a preferred embodiment, the patterned surface includes stepwise offset circular grooves, the grooves providing rotational freedom of angulation at multiple axes of rotation according to the crosswise displacement of the sliderblock in the mounting channel, thereby realizing independent, finely granular adjustment of stance and center of balance for the first time. The system may be used with most boot binding interfaces on the market and may be adapted for either splitboards or snowboards. Also offered are alignment tools for improving and simplifying ride mode interface setup. Advantageously, the system preserves optimal torsional stiffness K, a key parameter of performance in splitboarding and snowboarding.

27 Claims, 31 Drawing Sheets

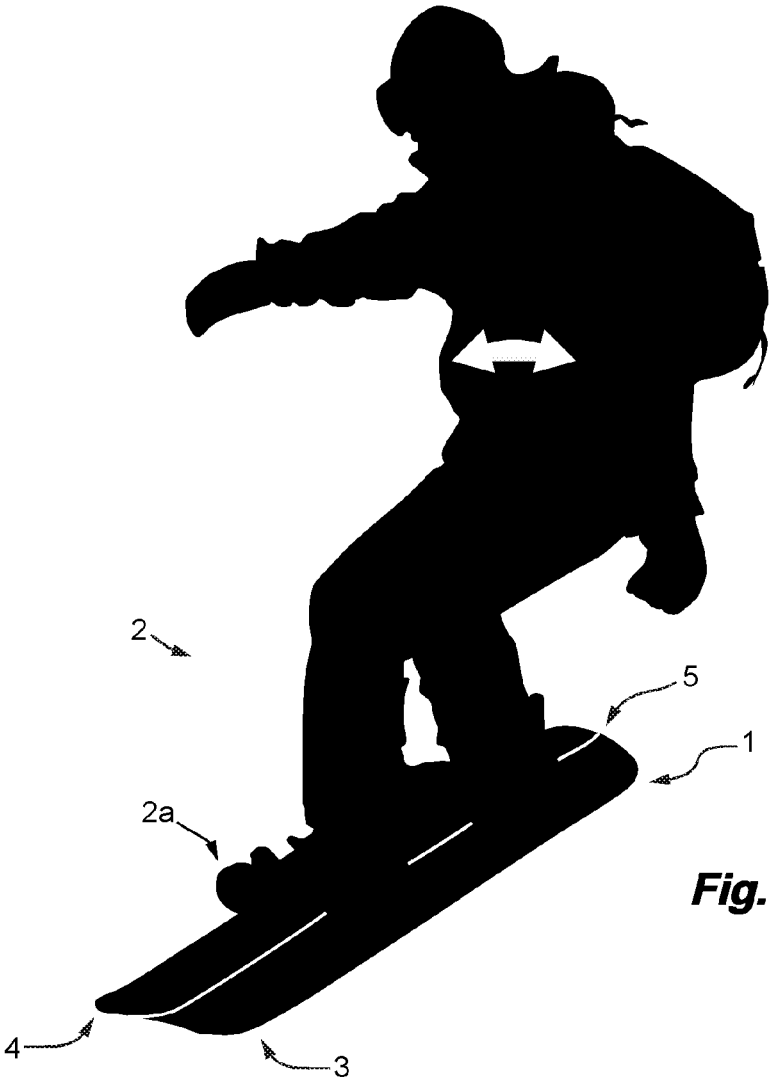
Fig. 1
Fig. 2
(Prior Art)
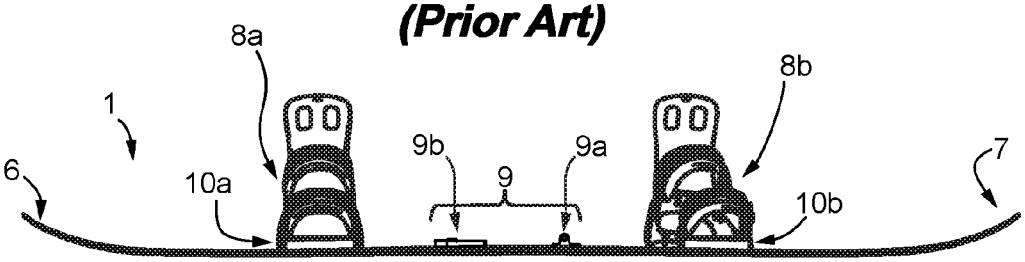

50

Fig. 6C
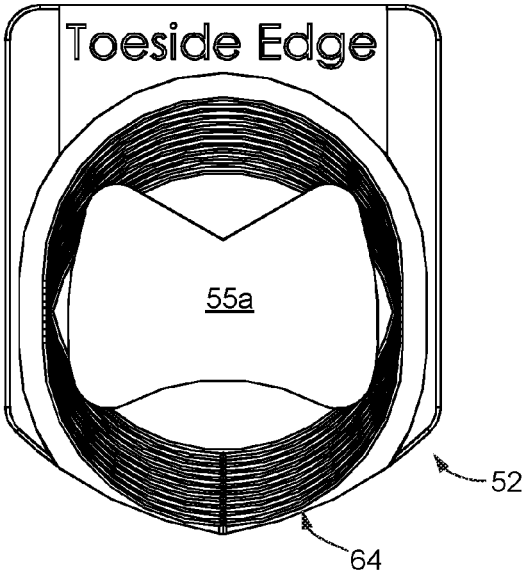
Fig. 6F
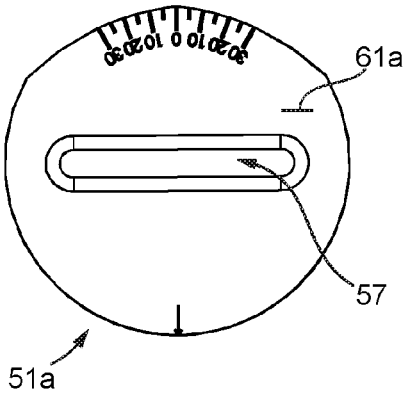
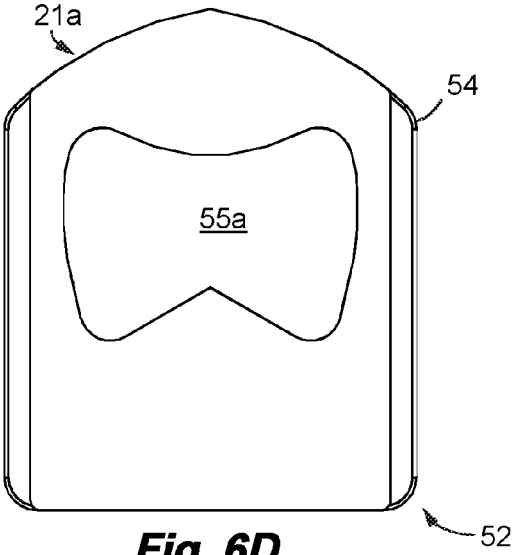
Fig. 6D
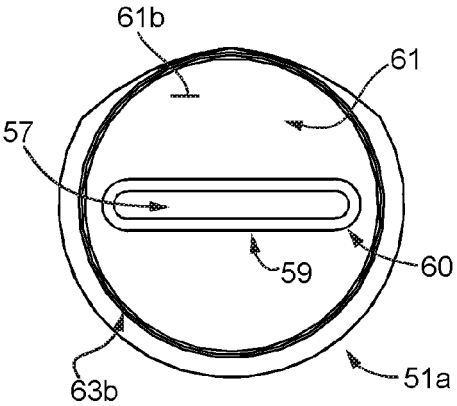
Fig. 6G
Fig. 6E
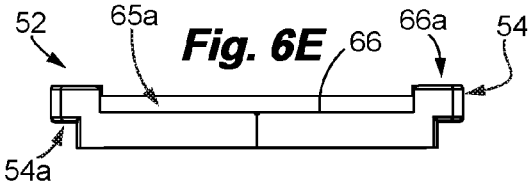
Fig. 6H
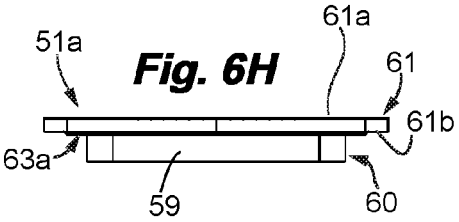

Fig. 7C
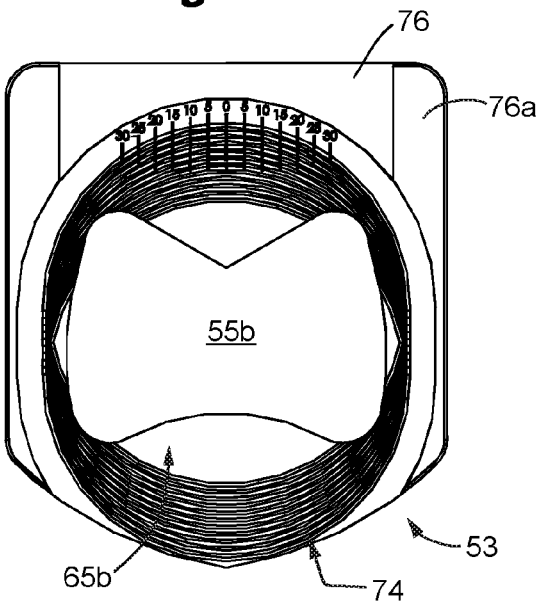
Fig. 7F
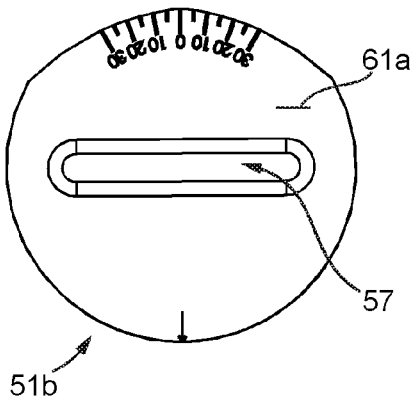
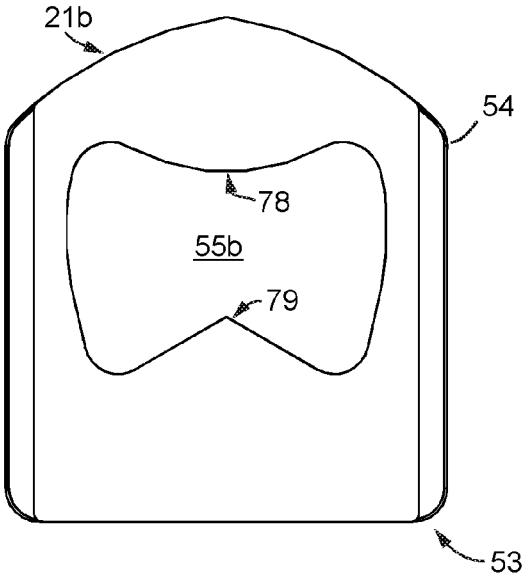
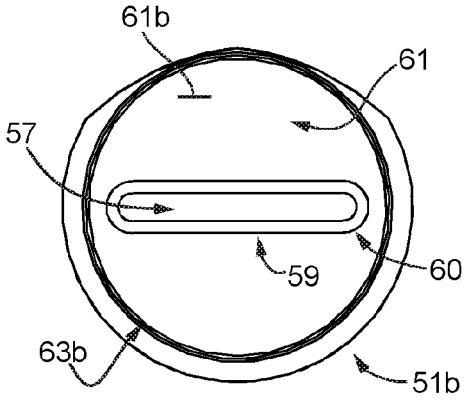
Fig. 7G
Fig. 7D
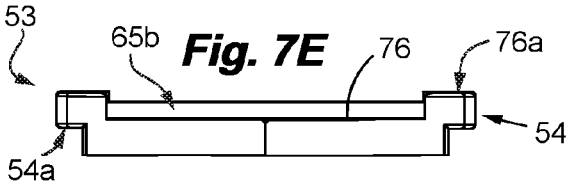
Fig. 7E
Fig. 7H
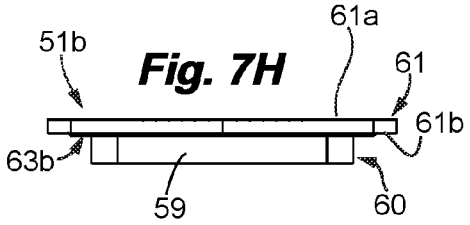

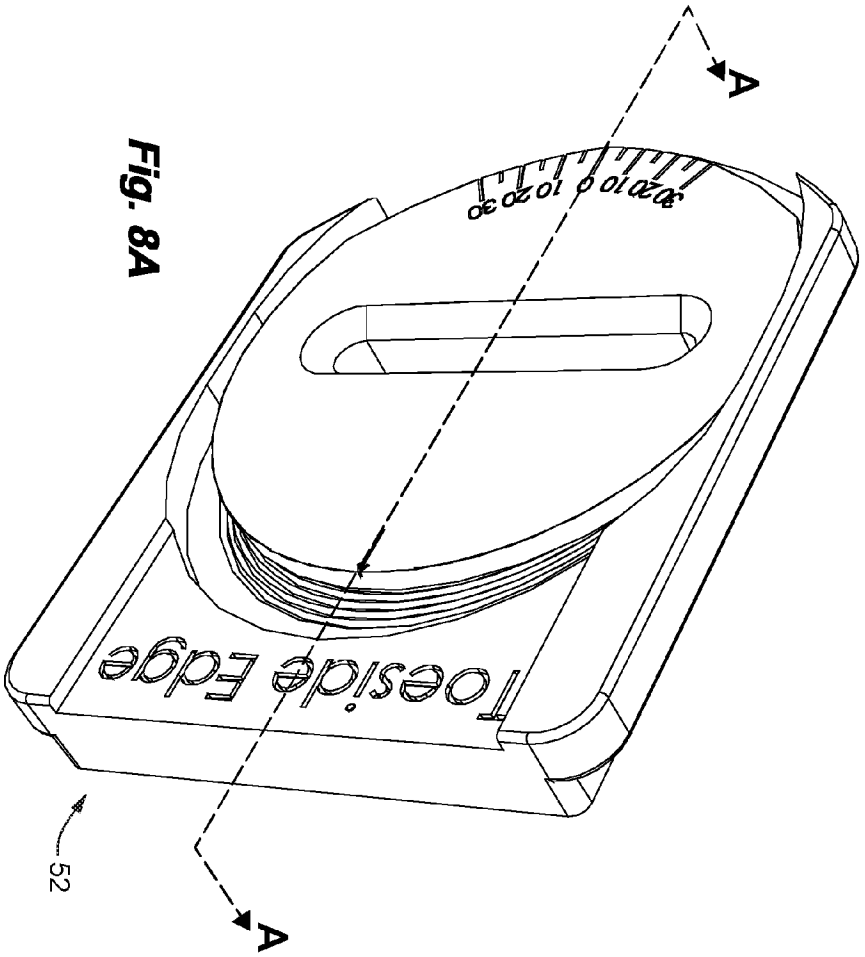
Fig. 8A
Fig. 8B
SECTION A - A
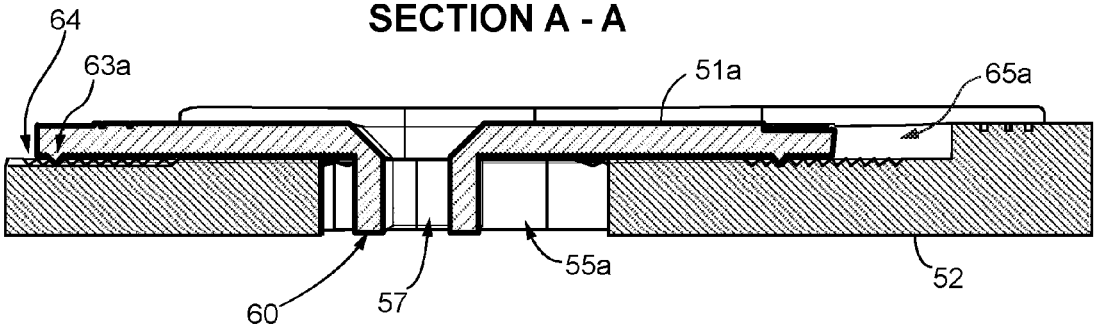

DETAIL VIEW, SECTION A - A

DETAIL VIEW

SECTION A - A

DETAIL VIEW, SECTION A - A

DETAIL VIEW, SECTION A - A

$\theta = 0°$ $\theta = 10°$ $\theta = 15°$

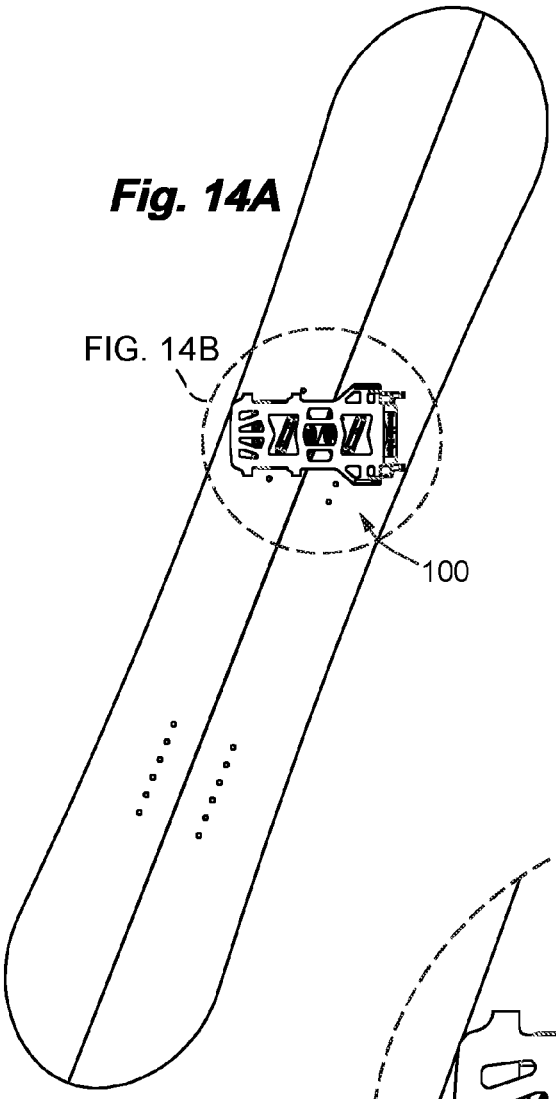
Fig. 14A
Fig. 14B
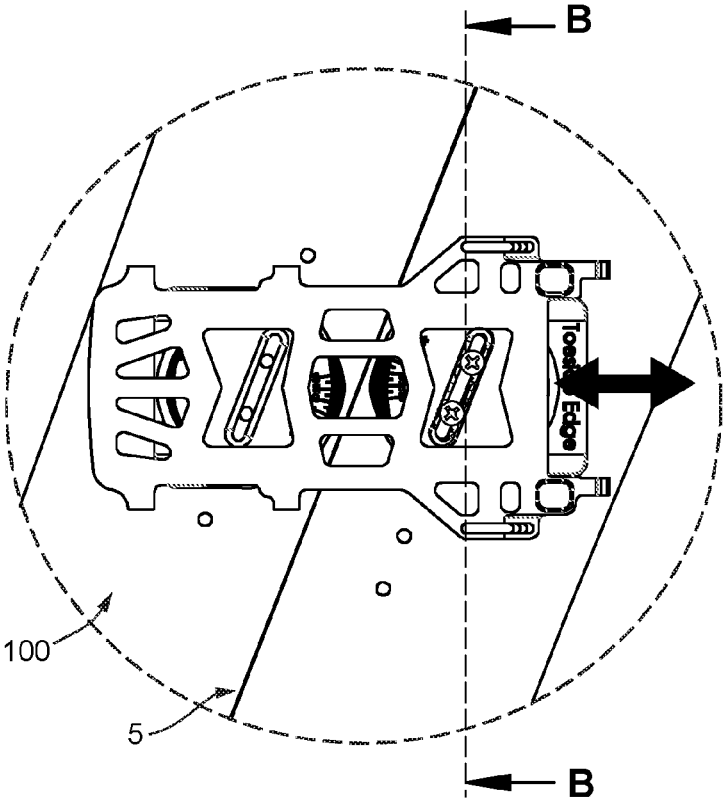

*Fig. 14C*
SECTION B - B
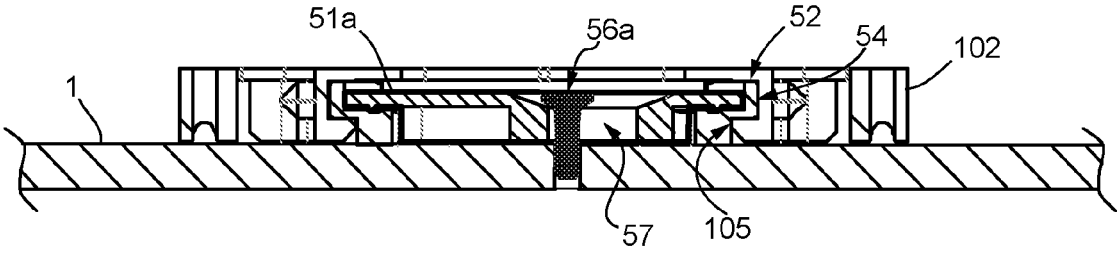
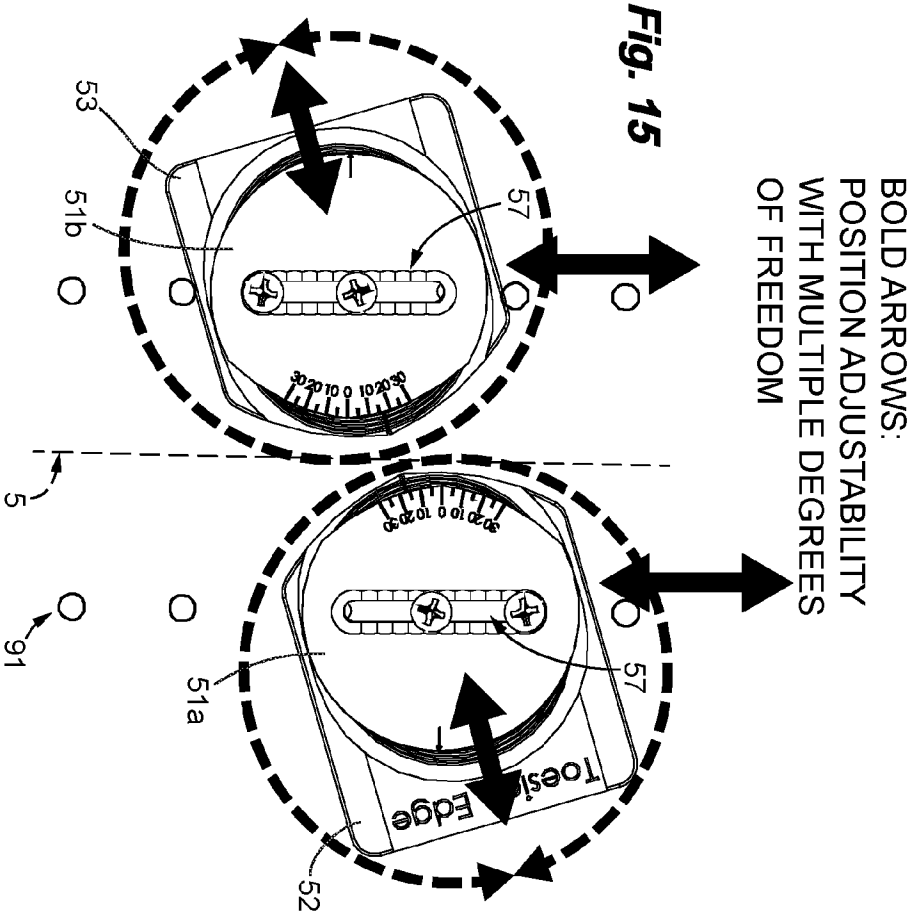
*Fig. 15*

PUCK SYSTEM

CROSS REFERENCE TO RELATED APPLICATIONS

This application is related to and claims the benefit of priority under 35 U.S.C. §119(e) to U.S. Provisional Patent No. 62/099,364, filed Jan. 2, 2015, which is herein incorporated in full by reference for all purposes. Also related are U.S. Pat. Nos. 7,823,905, 8,226,109, 9,022,412 and 9,126,099, co-owned by the applicant, and US Pat. Appl. Nos. 2014/0210187 filed 27 Dec. 2013 and 2015/0246278 filed 4 Mar. 2015, which are co-owned by the applicant and co-pending. All said patent documents are herein incorporated in full by reference for all purposes.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The invention relates generally to recreational snow equipment, such as snowboards, splitboards, and skis. More particularly, the invention relates to an improved binding system with novel puck members for securing a boot binding to a splitboard or a snowboard in an adjustable side stance.

BACKGROUND

Splitboarding (FIG. 1) is a well known winter sport and is growing internationally. Derived from snowboarding, the splitboarder may disassemble the board into two pieces and either carry the two ski halves or ski uphill (using climbing skins) to a backcountry destination; then reassemble the board halves and ride downhill as shown. To achieve this mixed function, two boot binding interfaces are provided: a "ski tour interface" is used for ski touring, and a "board ride interface" is used when riding a "solid board" configuration (sometimes termed "ride mode", or descent mode") in which the two ski members are conjoined as a single gliding board member (FIGS. 2-3). Riders are also increasingly using splitboards in-bounds and on lifts because of their flexibility in alternating between "tour mode" and "ride mode".

Splitboards were first made by Ueli Bettenman, as described in European Pat. Doc. Nos. CH681509, CH684825, German Gebrauchsmuster DE9108618 and EP0362782B1, first under the tradename Snowhow, and later in conjunction with Nitro (Seattle, Wash.). Advantageously, the rider's legs are rigidly anchored on the splitboard in ride mode, reducing the risk of knee injury associated with downhill skiing, but preserving the advantages of skis for cross-country and uphill skiing whenever needed by enabling the board to be "spilt" apart into skis.

Another early entrant commercially was Voilé (Salt Lake City, Utah). The popular "Split Decision" introduced a binding system essentially as described in U.S. Pat. No. 5,984,324 to Wariakois. The patent describes a "slider track" with insertable toe pivot pin for each foot, the slider track joining pairs of "pucks" mounted crosswise on each ski member and also serving as a pivot axle for free heel touring. This innovation resulted in substantial growth of interest in splitboarding in the United States and has had a worldwide impact on the sport. Ride mode interfaces of this type have been tested for over twenty years and have demonstrated a high level of consumer acceptance. However, there has been little innovation in the "pucks" during the almost twenty years of their use.

Ritter, in U.S. Pat. Nos. 7,823,905, 8,226,109, 9,022,412 and 9,126,099, described a stiffer, lower and lighter boot binding and interface system for using in ski and ride modes. The products are being commercialized by Spark R&D of Bozeman Mont.

Threaded inserts 91 are typically embedded in the board and are used conventionally to secure the pairs of sliderblocks to the board surface. However, conventional sliderblocks require a particular combination of slotted disks (FIGS. 3-4) that limits the operable stance adjustment by the rider to stepwise increments in length on the long axis of the board. Also, at least one such sliderblock is not readily adjustable in the crosswise dimension on the board, meaning that some riders may not achieve optimum foot positioning.

Conventionally, a reinforced nylon sliderblock having significant elasticity is used. The compliance of the material can reduce mechanical coupling between the board and the rider, limiting ride control. Efforts to reduce this elasticity have included substituting an all-metal binding interface (such as described by Maravetz in U.S. Pat. No. 6,523,851, Riepler in U.S. Pat. No. 8,033,564, and Kloster in U.S. Pat. No. 8,469,372), broadening the binding baseplate (Ritter in U.S. Pat. Nos. 9,022,412 and 9,126,099), and forming a modified sliderblock out of a metal or a stiffer composite (Ritter, patent pending).

While significantly stiffer, a metal puck was found to have an immediate disadvantage. Over time, the binding interface has been found to scuff and bite into the board surface and the inside rails of the binding, leading to looseness and reduced valuation of the used equipment. The metal puck also has limited elasticity, and hence cannot be as readily used in recreational maneuvers such as a foot roll, where a more elastic puck would allow the rider to lean into the board so as to load a spring force onto the block and then recover from the lean by letting the puck spring back, returning the force to the rider. For reference, optimal torsional stiffness of the entire binding system (including a boot) is in the range of 70 to 130 inch-lb/degree (Ritter, U.S. Pat. Nos. 7,823,905 and 9,022,412). Stiffness of the conventional puck (with box girder) is a substantial part of the total stiffness, and is about 150 to 300 inch-lb/degree when treated as part of a lever arm. Most conventional boots and boot binding systems provide much less stiffness. Thus, the elasticity of conventional blocks in the splitboard ride interface has been either too elastic or too stiff, and improvement is not readily accomplished except by trial and error.

Another problematic aspect relates to board construction. The boot binding interface must be affixed to the board using fasteners and embedded nuts termed "inserts" 91, but the installation of nuts in the board is difficult to standardize. Typically a row of inserts are placed in splitboards; a four-hole pattern is used for snowboards. Channels for moveable fasteners, termed "T-nuts", may also be cut for more flexibility. However, manufacturing tolerances associated with shaping and lamination processes can result in boards having asymmetrical arrays of inserts that only approximate an ideal position equidistant from the centerline of the board. These imperfections can shift the boot binding interface off the centerline and can affect the rider's balance, or lead to heel or toe drag (FIG. 1, 2*a*). When off center, heel turns will be less responsive than toe turns (or vice versa) depending on whether the binding is biased toewise or heelwise relative to the centerline of the board. Unfortunately, conventional mounting systems limit crosswise adjustment of the toe and heel, "crosswise" indicating an adjustment of the binding position relative to the lateral edges of the board. Thus it can be said that current systems are designed to facilitate adjustment with two degrees of freedom (one rotational, the other on the long axis of the board), but it has become apparent that a third degree of freedom (side-to-side) is also needed. There is currently no system for centering the boot binding interface (and stance) crosswise on the board while flexibly adjusting the separation distance between the sliderblocks. The difficulty increases as the sliderblocks are angled (relative to the long axis of the board), some riders preferring 20 or even 25 degrees of puck assembly angulation relative to the centerline axis of the board. Thus there has been a long-standing need for a boot binding interface system that overcomes these difficulties and is readily adjustable, with three degrees of freedom—including a toe-to-heel centering adjustment relative to the lateral edges of the board—according to a rider's preferred stance on the board. Most preferably, any innovation that meets this need would be adaptable to most of the boot binding interfaces and fastening systems currently available.

SUMMARY

A "splitboard" is a snow gliding board structured to be reversibly disassembled into separate ski-like members, thus allowing a rider to configure the board for use in a "ski tour mode" (with separated ski members) or in a "ride mode" (as a "solid board") such that the two ski-like members are fastened together at the midline. A "ski tour mode binding interface" and a "ride mode binding interface" are provided on which the boot bindings can be interchangeably mounted (in alternation), achieving a great deal of flexibility in use. In accordance with the present invention, a "puck system" is provided having three degrees of freedom in adjustment of stance, including nose-to-tail, toe-to-heel, and binding angulation adjustment, improving the ride. Post-manufacturing capacity to achieve toe-to-heel centering is realized for the first time. The puck system finds use in splitboarding and snowboarding.

Boot bindings include a baseplate member and are provided in pairs. Each boot binding baseplate is mounted cooperatively on a pair of puck assemblies, so that adjustments need to be made pairwise, moving each puck assembly in a coordinated motion. Pairwise position and orientation adjustments include: a) boot placement relative to the nose end and tail end of the board, b) boot binding angulation optimal for the rider, and, c) crosswise centering for each boot relative to the edges of the board. The puck systems of the invention provide essentially the same longwise stance adjustment as a board having slideable fasteners in channels (instead of the more common array of stationary embedded inserts) without any compromise on board strength and flex, and surprisingly, enables a finely adjustable range of "toe-to-heel" crosswise centering not previously possible, whereby toe and heel are equidistant from the centerline of the board and from the board lateral edges. To secure the fully assembled "puck system" in the desired position and orientation, two screws are affixed to inserts pre-set in the board for each puck assembly. These screws capture the sliderblock member under the flanged disk, which acts as a reinforcing, locking and compression member.

A preferred embodiment includes a puck assembly made using different materials for the sliderblock and reinforcing members. As preferredly practiced, a metal flanged disk locks down and immobilizes a plastic or composite sliderblock; the plastic sliderblock shields the board surface from damage by the metal disk. Together the metal flanged disk acts as a reinforcing and compression member and is more compatible with metal fasteners. The plastic sliderblock includes a recessed topside "mounting channel" with lips that capture the metal disk. The flanged disk includes a slotted post for receiving two mounting screws so that the sliderblock can be slid along the mounting channel to achieve a variable and smooth range of boot placement when used in combination with the row of inserts 91 in the board surface. The puck assembly structure allows the sliderblock to be rotated on the flanged disk to find a comfortable boot angulation, to be moved crosswise into a center position on board, and then to then be locked in place with fasteners threaded into the board.

The initial expectation was that a plastic sliderblock mounted on a rigid post could experience failure or stretching of the plastic, and may result in catastrophic sudden falls from the board when the tensile and/or elastic bending strength of the plastic is exceeded. To overcome this, the rigid post is provided with a flat cap plate with lip or plate that extends onto and in part over the plastic flange, reinforcing the plastic and preventing deformations that lead to failure. The flanged reinforcement, termed here a "cap plate" is seated on a metal post with elongate slot extending crosswise across the middle. Added strength is achieved by modeling a recessed mounting channel (65*a*,65*b*) in the sliderblock and seating the flange disk in the channel. Surprisingly, the thickness of the sliderblock around the post, and the material selection, as realized by trial and error, was found to prevent failures. Synergically, exterior raised lips (66*a*,76*a*) defining the channel were modeled as external superiolateral flange flats 54 as needed to slidingly mate with and conjoinedly interlock the sliderblocks of the ride mode interface in an underside channel in the boot binding baseplate while engaging the toe locking mechanism at a more toeward position on the board.

Thus the invention may be characterized in part by a number of concepts. A first aspect involves a puck system characterized as designed and configured for mounting a pair of boot bindings on a snow gliding board, which comprises a pair of puck assemblies for cooperatively mounting each boot binding, where each puck assembly of the pair comprises a sliderblock, a flanged disk, and at least one fastener, and further where the pair of puck assemblies are configured to cooperatively adjust stance orientation for each boot binding independently in three degrees of freedom including: a) pairwise boot positions relative to the nose end and tail end of the board), b) pairwise boot angulation optimal for the rider, and, c) pairwise crosswise centering for each boot relative to the edges of the board.

In a first embodiment, the puck system comprises a first pair of puck assemblies for a first boot of a rider and a second pair of puck assemblies for a second boot of a rider, each the puck assemblies of the pair comprising a) a sliderblock having contralaterally disposed superiolateral edge flanges, where the edge flanges define a slider track configured to receive an underside channel of a boot binding thereon; b) a flanged disk configured to seat on top of the sliderblock between the edge flanges; c) at least one fastener affixable to mounting hardware disposed in a top surface of a snow gliding board; where the at least one fastener is adapted to capture the sliderblock under the flanged disk and compressedly lock the sliderblock between the flanged disk and a top surface of a snow gliding board on which the sliderblock rests; further in which, i) the flanged disks are configured to be slideably adjusted pairwise on the at least one fastener longwise on a centerline of the snow gliding board, thereby defining a first degree of freedom for adjustment of stance; ii) the sliderblocks are configured to be adjustably rotated pairwise on the flanged disk relative to a centerline of the snow gliding board, thereby defining a second degree of freedom for adjustment of stance; and, iii) the sliderblocks are configured to be slideably adjusted pairwise on the flanged disks crosswise relative to a centerline of the snow gliding board, whereby a boot binding is adjustable toe-to-heel to be equidistant from the lateral edges of a snow gliding board, thereby defining a third degree of freedom for adjustment of stance. The third capacity, defining a third degree of freedom for slideably adjusting stance, is believed to be novel and surprising in its invention.

A preferred embodiment is a puck system as above, where a) the flanged disk comprises a cap plate with underside surface and flange edge, a mounting post centrally dependent from the underside surface, a detent feature peripherally disposed on the underside surface; and, b) the sliderblock comprises a top surface having a recessed mounting channel for receiving the cap plate with flange edge, a center cutout for receiving the mounting post, and a patterned surface on the top surface for engaging the detent feature of the flanged disk. In yet another preferred embodiment of a puck system as above, the detent feature is a circular detent ridge and the patterned surface comprises a plurality of mating circular female grooves, each groove being offset stepwise along the mounting channel, each groove defining one of a plurality of axes of rotation of the sliderblock on the detent ridge, each the axes of rotation having a incremented stepwise offset from a centerline of a snow gliding board. Rather than their being one round "home" for the flanged disk to rotate in, a plurality of seats are provided for the circular detent ridge, each seat having an offset and thus forming a pattern of closely spaced but laterally shifted circular grooves. This geometry unlocks the stance options in terms of angle, foot placement, and toe-to-heel centering on the board. Each adjustment is incorporated in a different degree of freedom of the pucks, and now each adjustment may be addressed independently without compromise. "Toe-to-heel" centering is an advance in the art. Future generations of board riders will be able to use a puck system with binding baseplates having dimensions not limited by the need to standardize the baseplate to the sliderblock geometry currently available. In fact, the boot binding baseplate may be resized to fit individual sizes of feet, such as small, medium and large, and yet remain compatible with a standard ride mode interface.

These and other elements, features, steps, and advantages of the inventive puck systems will be more readily understood upon consideration of the following detailed description, taken in conjunction with the accompanying drawings, in which presently preferred embodiments of the invention are illustrated by way of example.

BRIEF DESCRIPTION OF THE DRAWINGS

The teachings of the present invention are more readily understood by considering the drawings, in which:

FIG. 1 illustrates the sport, showing a downhill rider on a splitboard.

FIG. 2 is a prior art view, showing use of a flanged baseplate to secure a boot binding to an interlockably flanged slider block mounted on the splitboard. The boot binding flanges are aligned so that the baseplate can readily slide onto the flanged blocks.

FIGS. 6C, 6D, 6E, 6F, 6G and 6H are isometric views of a toeside sliderblock and reinforcing flanged disk with slot for receiving threaded fasteners.

FIGS. 7C, 7D, 7E, 7F, 7G and 7H are isometric views of a heelside sliderblock and reinforcing flanged disk with slot for receiving threaded fasteners.

FIG. 8A is a perspective view of a puck assembly of the invention showing the position of center section A-A. FIG. 8B is a center section at A-A through the puck assembly.

FIG. 14A is a plan view of a splitboard showing a binding baseplate and sliderblock assembly in ride mode. FIG. 14B is a detail view showing section plane B-B. FIG. 14C is a section view at B-B therethrough.

FIG. 15 is a schematic view of stance adjustment using the pucks of the invention, demonstrating three degrees of freedom needed for a completely adjustable snowboard interface.

Figure 3:
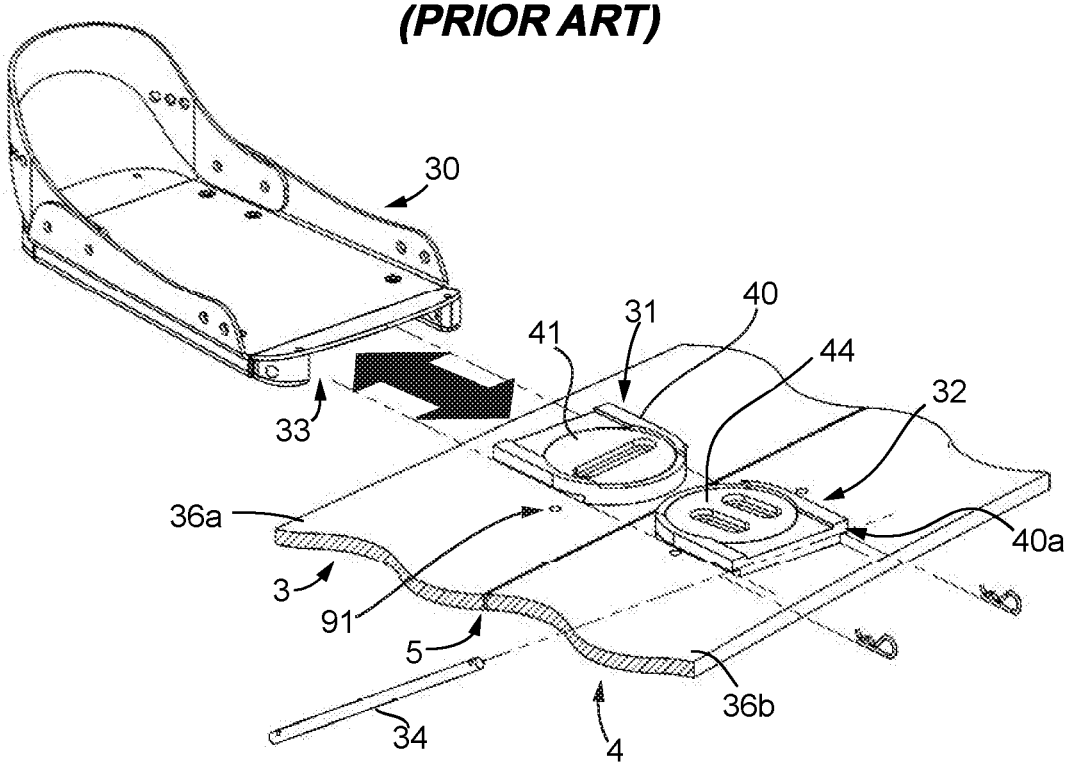
Fig. 3 (PRIOR ART)
FIG. 3 is a prior art view of a set of conventional puck assemblies used in splitboarding.

The drawing figures are not necessarily to scale. Certain features or components herein may be shown in somewhat schematic form and some details of conventional elements may not be shown in the interest of clarity, explanation, and conciseness. The drawing figures are hereby made part of the specification, written description and teachings disclosed herein.

It is to be expressly understood, however, that the drawings are for illustration and description only and are not intended as a definition of the limits of the invention. The various elements, features, steps, and combinations thereof that characterize aspects of the invention are pointed out with particularity in the claims annexed to and forming part of this disclosure. The invention does not necessarily reside in any one of these aspects taken alone, but rather in the invention taken as a whole.

GLOSSARY AND ANNOTATIONS

Certain terms are used throughout the following description to refer to particular features, steps or components, and are used as terms of description and not of limitation. As one skilled in the art will appreciate, different persons may refer to the same feature, step or component by different names. Components, steps or features that differ in name but not in structure, function or action are considered equivalent and not distinguishable, and may be substituted herein without departure from the invention. Certain meanings are defined here as intended by the inventors, i.e., they are intrinsic meanings. Other words and phrases used herein take their meaning as consistent with usage as would be apparent to one skilled in the relevant arts. The following definitions supplement those set forth elsewhere in this specification.

"Snow gliding board" (generally, a "board"), includes snowboards and splitboards intended for use with two feet strapped to a solid or unitary member. "Board", a generally elongate and generally planar unitary member with a surface intended for supporting a standing rider on two feet while descending a slope over snow or icy ground; typically a "splitboard" or a "snowboard" as used here. Ski members are differentiated by being used separately, one per foot, as known in the art.

"Splitboard": a combination consisting of two separable ski members, each generally having one non-linear ski-like longitudinal edge, that can be conjoined at opposing lateral straight edges (defining a board "centerline" or "seam") to form a snow gliding board. The ski members are typically shaped so as to approximate the right and left halves of a snowboard respectively. The tips of the ski members are generally secured together in ride mode configuration by use of hooks, pins, or other conjoining apparatus, but the relative stiffness of the coupling is largely the result of the mechanics of the transverse union formed by the puck system and boot binding hardware straddling the separate ski members.

"Ride" or "riding": a noun or verb used by splitboarders and snowboarders to indicate the distinctive descent on snow experienced by a rider on a snowboard (or on a splitboard in ride mode). Snowboarders and splitboarders ride; skiers ski.

"Ski tour" or "touring", when used as a noun, indicates a trip through areas typically away from ski resorts, often referred to as "backcountry", which may include traversing flat areas, ascending inclined slopes, and descending slopes. Touring is done using one or several of the following pieces of equipment: skis, poles, snowshoes, snowboards, or splitboards. When used as a verb, indicates: to enter the backcountry, typically away from a ski resort, and perform one or more of the following: traverse flat areas, ascend inclined slopes, and descend slopes using one or more of the following pieces of equipment: skis, poles, snowshoes, snowboards, or splitboards. With reference to splitboards, the terms "board ride mode" and "ski tour mode", have special meaning because the splitboard is provided with interfaces for interchangeably performing both.

A "ski tour mode binding interface" is a boot binding interface affixed to splitboard or more specifically to the ski members of a splitboard, the interface having a toe pivot bracket or cradle for pivotably mounting a boot binding thereon. The ski tour interface is used for ski touring and cross-country skiing, as may be termed here "ski tour mode". With reference to splitboard, the term "ski tour mode" indicates a skiing method in which the two ski members of a splitboard are separated and are attached one to a leg, typically with a free heel binding, such as is used to ascend slopes and flats where board ride mode is not possible. More generally, a ski tour interface refers to hardware, brackets, pins or blocks secured on the surface of each ski, generally centrally placed, so that boot bindings can be fastened to them, one boot to a ski. In the most common conventional device, a ski touring pin cradle and pivot pin is used with a pivotable boot binding baseplate, the purpose of which is to provide a hinged coupling between the boot and its counterpart ski member, as in telemark skiing and "free heel" skiing. Heel locking devices may also be used, however. A ski mounting block may take the place of the pin cradle and may be used with boot mounting tongues, cables, or other pivoting means. Incorporated herein by reference with respect to pivoting means are U.S. Pat. No. 5,649,722 to Champlin, U.S. Pat. No. 6,685,213 to Hauglin, U.S. Pat. No. 5,741,023 to Schiele, US Pat. Appl. 2005/0115116 to Pedersen, and their cited and citing references.

A "ride mode binding interface", also termed a "ride mode interface" or perhaps more accurately termed "descent mode interface", is boot binding interface affixed to a board so that a rider can ride downhill on snow with legs apart, knees flexed, and body generally in a side stance on the board. The ride mode interface is used when the board is ridden in the manner of a snowboard. With reference to splitboards, the ride mode interface comprises paired puck assemblies, two for each foot, such that members of each pair are affixed to opposite ski halves of a splitboard, so that when each of a rider's boot bindings are engaged on the paired pucks (the underside channel of the bootbinding engaging mated parallel contralateral superiolateral flanges (the "slider track") of the sliderblocks), the ski halves of the splitboard are joined to each other. The "ride mode interface" is preferred for descending snowy slopes, as may be termed here "ride mode".

A "puck system" is defined by paired puck assemblies, each puck assembly including one sliderblock, one flanged disk and any fasteners for slideably receiving a boot binding baseplate of each foot. The puck system is made up of two pairs of puck assemblies (one pair for each boot) forming the ride mode binding interface as installed on a board and in kits having components thereof.

A "puck assembly" is a composite part or assembly, generally having two nested pieces: 1) a "flanged disk" with underside mounting post and cap plate, the cap plate having a generally diametrical slot for receiving a pair of threaded fasteners and a flange edge, and 2) a "sliderblock", the sliderblock having a pair of contralateral parallel exterior flanges for receiving and grippingly conjoining the inside inferiolateral flanges of a boot binding baseplate. The slot in the cap plate extends through the mounting post. Fasteners admitted to the slot are threaded into hardware in the board and capture the sliderblock between the flanged disk and the top surface of the board on which the sliderblock rests; compressive pressure on the sliderblock locks the puck assembly in place.

In more detail, "sliderblocks" are part of the "puck assemblies" affixed on either side of the centerline of a board so that a boot binding baseplate can be slideably mounted on the sliderblocks and locked in place. For splitboards, the sliderblock/baseplate combination also serves to conjoinedly and flangedly interlock the two ski halves together in ride mode configuration. In practice, paired pucks having parallel superiolateral flange flats are positioned on the opposing ski members and form a "slider track" to receive a boot binding baseplate; the baseplate/sliderblock combination, with accessory fittings, conjoins and interlocks the two ski members into a rigid solid board for the downhill ride. Sliderblocks are provided in pairs, including two toeside sliderblocks and two heelside sliderblocks. The "slider block" assemblies of the prior art (FIG. 2 and FIG. 3) are undifferentiated and are described in U.S. Pat. No. 5,984,324; in contrast, the sliderblocks of the present invention are distinguished by their structure and advanced functional properties, as described here.

The "flanged disk" includes a slot extending from one side of the disk to the other and having a raised underside post, the post wall defining the slot, the slot for receiving two screws that are threaded into mating female fasteners (termed in the art "inserts") that are pre-mounted and embedded in the board. For use in the puck system of the invention, flanged disks may be supplied in kits of four each, one for each of the sliderblocks, such that the flange disks are interchangeable among the slider blocks. Each flanged disk is trimmed symmetrically to form a point at mid-section perpendicular to the slot. The reinforcing cap plate and slotted post secures the sliderblock in place as will be show for example in FIGS. 9B through 9D, and FIG. 14C, which show a cross-section through a puck assembly. Optionally, the flanged disk may be formed of a stiffer plastic instead of a metal, such as having fiber reinforcement for stiffness, and the sliderblock may be formed of a tough but somewhat elastic material selected for its spring constant. Sliderblocks may be fabricated from metal, such as aluminum or aluminum alloys, titanium, steel, spring steel, and so forth, or from plastic or reinforced plastic, either molded, machined, cast, or extruded so as to benefit from differing material properties.

"Material properties": refer to properties of materials that vary from material to material, for example hardness, density, modulus of elasticity, tensile strength, wear properties, fatigue resistance properties, and so forth. Material properties may be uniform from member to member, as in a monolithic article cut from a single block or an article folded from a single sheet, or may be different. The material properties of aluminum, for example are different from the properties of UHMWPE, filled plastic, or steel, for example. Substituting one material for another results in a member having different material properties. Useful materials include UHMWPE because of its toughness, resistance to wear, and lightness, but plastics such as nylon, polypropylene, polycarbonates, polyesters, acrylates, polyimides, and polyamides or reinforced composites such as polyester fiber, carbon fiber, polyamide fiber, filled nylon, or polyaramid fiber thermosets may also be suitable. Reinforcing fibers of glass, KEVLAR® or carbon are frequently used to add stiffness and reduce stretch and to modify the bending moment and torsional stiffness of a plastic member.

"Receiving and grippedly conjoining" refers here to the cooperative action of slidingly and reversibly engaging a pair of puck assemblies with external superiolateral flange flats with an adaptor mounting plate of the prior art or with a binding baseplate having mating internal flanges—so as to conjoin two ski members in snowboard riding configuration (also termed "descent mode" in the art).

"Torsional stiffness": in its simplest engineering analysis, torsional stiffness can be approximated by a form of Hooke's law relating torque to deformation:

$$T=K*\Delta\theta \qquad \text{(Equation 1)}$$

where T is torque, K is a spring constant reflecting the stiffness, and $\Delta\theta$ (theta) is the angular deformation or displacement relative to the pivot of a lever arm. A more complex model including elastic shear modulus, loss shear modulus, and dampening coefficients may also be formulated. Considering only the ride mode interface and baseplate, a preferred level of torsional stiffness is in the range of 150 to 300 in-lb/degree when taken as rotation of the baseplate when mounted on a pair of puck assemblies on a board. A corresponding preferred level of torsional stiffness taken for the binding interface as a whole (i.e., with boot and boot binding upper) is in the range of about 50 to 150 in-lb/degree, most preferably in the range of 70-130 in-lb/degree. The composite stiffness of the boot with boot binding upper is typically less than the stiffness of the binding interface so as to permit a greater range of ankle motion. An increase or decrease in torsional stiffness of 50% is highly significant and is readily perceptible to a rider. Below the preferred range, most riders experience lower spring constants K as "wobbliness" or "play", causing a lack of control.

"Foot roll": is a term used in the art to denote the freedom of angular leg movement experienced by a board rider. The rider uses foot roll to shift the pressure or "bite" of the board on the underlying snow and to control the ride. Foot roll is essentially the "$\Delta\theta$" in the equation for torsional stiffness. Optimizing the stiffness factor K, optimizes the control of the ride achieved with foot roll.

"In alternation" or "in turn" refers to the interchangeability of the boot binding system between a ride mode interface and a ski touring mode interface, but may also include switching the system from one gliding board to another board having a compatible interface. Thus any combination of interfaces may be selected in turn because the engagement interfaces enable attachment to any of them.

General connection terms including, but not limited to "connected", "attached", "conjoined", "secured", and "affixed", are not meant to be limiting, such that structures so "associated" may have more than one way of being associated. "Fluidly connected" indicates a connection for conveying a fluid therethrough.

Relative terms should be construed as such. For example, the term "front" is meant to be relative to the term "back," the term "upper" is meant to be relative to the term "lower," the term "vertical" is meant to be relative to the term "horizontal," the term "top" is meant to be relative to the term "bottom", "inside" is relative to the term "outside", "toeward" is relative to the term "heelward", "toeside" is relative to the term "heelside", and so forth. Unless specifically stated otherwise, the terms "first," "second," "third," and "fourth" are meant solely for purposes of designation and not for order or for limitation. Reference to "one embodiment," "an embodiment," or an "aspect," means that a particular feature, structure, step, combination or characteristic described in connection with the embodiment or aspect is anticipated to be included in at least one realization of the present invention. Thus, the appearances of the phrases "in one embodiment" or "in an embodiment" in various places throughout this specification are not necessarily all referring to the same embodiment and may apply to multiple embodiments. Furthermore, particular features, structures, or characteristics of the invention may be combined in any suitable manner in one or more embodiments.

It should be noted that the terms "may", "can", and "might" are used to indicate alternatives and optional features and only should be construed as a limitation if specifically included in the claims. The various components, features, steps, or embodiments thereof are all "preferred" whether or not it is specifically indicated. Claims not including a specific limitation should not be construed to include that limitation. The term "a" or "an" as used in the claims does not exclude a plurality.

Unless the context requires otherwise, throughout the specification and claims that follow, the term "comprise" and variations thereof, such as, "comprises" and "comprising" are to be construed in an open, inclusive sense—that is as "including, but not limited to."

"Conventional" refers to a term or method designating that which is believed known and commonly understood in the technology to which this invention relates.

The appended claims are not to be interpreted as including means-plus-function limitations, unless a given claim explicitly evokes the means-plus-function clause of 35 USC §112 para (f) by using the phrase "means for" followed by a verb in gerund form.

Unless otherwise defined, all technical and scientific terms used herein have the same meaning as commonly understood by one of ordinary skill in the art to which this invention belongs. In case of conflict, the present specification, including definitions, will control.

DETAILED DESCRIPTION

FIG. 1 illustrates the sport of splitboarding as a context for the invention, the drawing showing a downhill rider 2 on a splitboard 1. Riders are able to make their way in the backcountry to a top of a mountain through fresh-fallen snow for example, and assemble the splitboard from its separate parts 3,4. The splitboard is shown joined on a split seam at long axis centerline 5. The rider assumes a generally side stance on the board and rides the downhill in the manner of a snowboard. By comparison with snowboarding, the ability to ski up an ascent (without a lift) requires substantially less effort. Climbing skins are admirably adapted for skiing uphill. And for the descent, compared to skiing, the side stance provides better protection for the knees and a unique experience. The figure was chosen because it is also is suggestive of a binding interface mounted with a pronounced toeward bias 2*a*, pointing to the need for a puck system enabling "toe-to-heel crosswise adjustment", as is disclosed here.

FIG. 2 is a prior art view, showing a conventional splitboard ride mode interface (10*a*,10*b*) with boot bindings (8*a*, 8*b*) secured to splitboard 1. Generally the rider's stance is selected so that one end of the board is the nose (6) and the other the tail (7). Also shown is a ski tour interface 9 with toe pivot cradle 9*a* and heel rest 9*b* as known in the art.

FIG. 3 is a prior art view of a conventional set of "puck" assemblies (prior art: 31,32) forming a conventional splitboard ride mode interface for one foot. To mount boot binding baseplate 30, an underside channel 33 is provided so that the baseplate can slide tightly onto mating flanges (forming a "slider track") of the puck assemblies, with a narrow clearance between the boot binding baseplate and the top surface of the board (illustration adapted from U.S. Pat. No. 7,823,905 to Ritter, which is co-owned by the inventor). The user inserts a toe locking pin 34 or other toe locking means snugly against the outside edge of the toe slider block to lock the baseplate in position. The removable toe locking pin (or other locking means) prevents slippage of the boot binding baseplate on the sliderblocks and the toe locking pin also functions as a toe pivot axle in ski tour mode.

The conventional ride mode interface includes a pair of slider blocks 40 with external flanges 40*a*, two circular flanged disks (41,44) molded of glassed nylon that are designed to allow rotational positioning of the slider blocks, and a rubber gasket to be placed under each slider block. One pair of pucks is used to mount a boot binding for each foot and also works to join the splitboard halves (3,4). When bootbinding baseplate 30 is slid onto flanges 40*a* of the pucks and locked in place, the ski halves are conjoinedly and flangedly interlocked at mating flanges on the inside surfaces of underside channel 33, resulting in a rigid union of the board ski halves.

One circular disk 44 includes two slots, the other 41 has one slot. In use, one disk has freedom to be adjusted along the long axis of the board and the other disk can be adjusted crosswise on one of the skis, but in conventional practice must match a fixed end-to-end distance of 7⅝ inches (as specified in FIG. 4), and hence does not provide added lateral adjustment. Both slider blocks may be rotated on the flanged disks so that the rider's stance may be angled, but the combination provides no flexibility to avoid heel or toe overhang in ski tour mode if the pucks are not centered.

Two screws (shown in FIG. 5A) are used to affix each puck assembly (31,32) to the corresponding splitboard half members (3,4), which are typically pre-fitted on an upper surface (36*a*,36*b*) each with a row of six "inserts" (mounting holes with embedded nuts, 91) per board half, at about a 1 inch spacing—about where a rider's boot will need to be.

Figure 4:
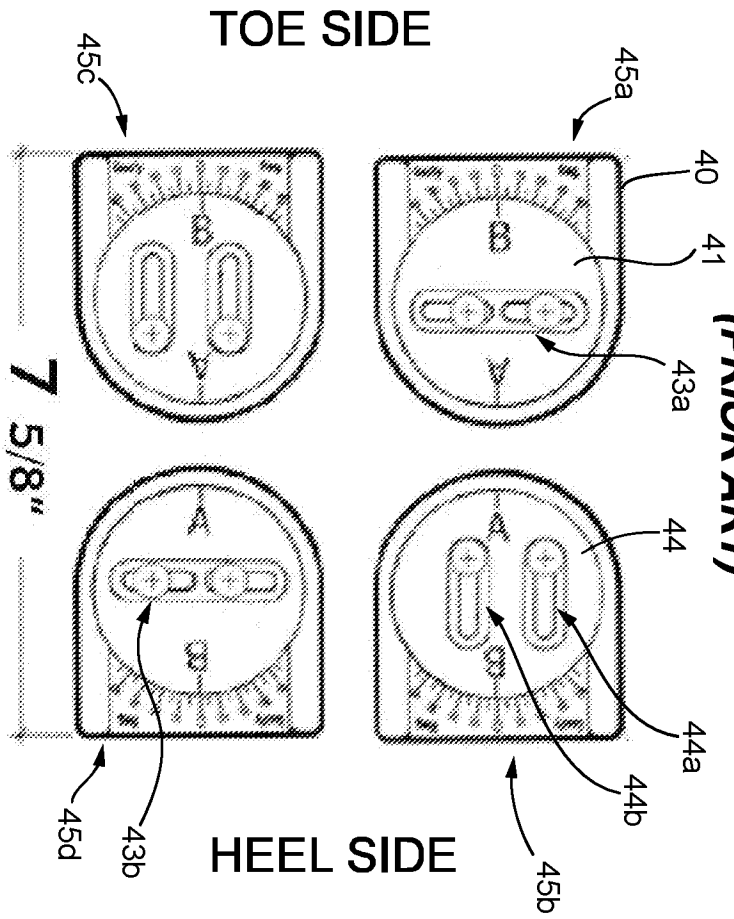
Fig. 4 (PRIOR ART)
FIG. 4 is a view of an installation guide for adjusting rider stance with a set of conventional puck assemblies used in splitboarding.

FIG. 4 shows one of four possible combinations of the four slider blocks and disks. The figure is adapted from "Interface Set-up Instructions" by Voilé, Inc. (undated), which is incorporated in full by reference. The ride mode interface includes a right toeside puck assembly 45*a*, a right heelside puck assembly 45*b*, left toeside puck assembly 45*c*, and left heelside puck assembly 45*d*, each consisting of a slider block 40, a one-slot or a two-slot circular disk (41,44), and fasteners. One disk pair has a pair of slots (44*a*,44*b*); the other disk pair has a single slot (43*a*,43*b*).

As shown here, both disks for each foot are oriented with the "A" mark pointed centerwise. Slot 43*a* is slightly offset relative to the center of the disk and may be "flipped" if desired. For example, for the right foot, the crosswise position may be shifted by turning disk 41 from a "centerwise A" position to a "centerwise B" position, allowing a ¼ inch shift toewise of the entire interface for that foot. After disk 41 is positioned, disk 44 is moved on parallel slots (44*a*,44*b*) to the currently required separation distance, so is not independently adjustable.

However, in either of the two positions A or B, the puck assembly will generally be biased by a fixed increment to one side or the other of centerline 5, as dictated by the fixed end-to-end distance behind the toe locking pin, an undesirable outcome for the rider, who must balance while off center. For riders who chose a more angulated stance, the bias increases, particularly where different stance angles are desired for the nose-positioned and tail-positioned boot bindings. This is because puck angle and centering are not independent; each conventional slider block has no fine adjustment relative to the circular disk except to rotate around the center axis. The apparent range provided by the parallel slots (44*a*,44*b*) does not actually contribute to centering because it is designed entirely to snug up the pucks against the toe pin 34. A good fit is essentially entirely dependent on the position and standardization of the threaded insert 91 array in the board and on the size and shape of the boot binding baseplate, all of which may vary from manufacturer to manufacturer. Boot size is also a factor in preventing most riders from achieving a good center of balance on the board.

Figure 5A:
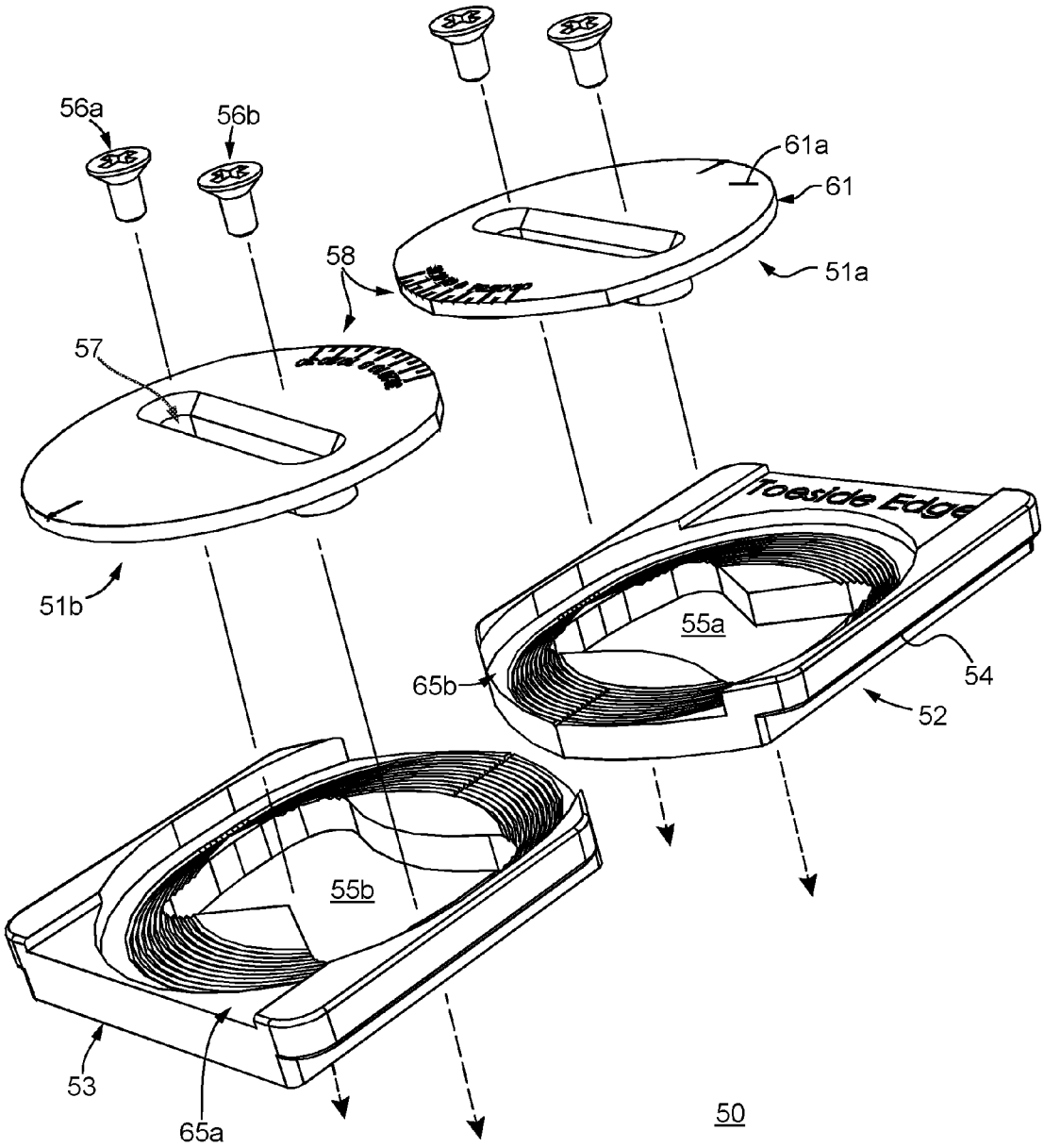
FIG. 5A is a top-down exploded view of the structure of a "puck" assembly of the invention.

FIG. 5A is a top-down exploded view of a representative puck system 50 of the invention. In this embodiment, a flanged disk (51*a*,51*b*) is inserted into a sliderblock (52,53), the sliderblock having a generally rectilinear or generally trapezoidal outside border. The shape is suggested by the need for parallel flange flats (54). Each flanged disk is held in place by two screws (56*a*,56*b*) through mounting slot 57 and by the walls of a recessed mounting channel (65*a*,65*b*) in the sliderblock. Flathead mounting screws are threaded into female nuts embedded or inserted in the board surfaces. When bolted onto a board (not shown) the sliderblocks are stiffened and held in place by compression between the flange (termed here the "cap plate" 61 with upper surface 61*a*) of the flanged disk and the board and by detent features described below.

For each foot, a puck on one board half is aligned with a puck on the second board half so that a boot binding may be slid cooperatively onto parallel external flanges 54 of the two pucks. The user can select an angular orientation and a stance before locking the pucks in place. Indicia 58 useful for making positional adjustments for a rider's stance are also provided.

Sliderblocks are provided as pairs, each pair including one toeside sliderblock and one heelside sliderblock, but the pairs may be used interchangeably for either a left foot or a right foot, and can be used at either the nose-facing end or the tail-facing end of the board relative to the downhill orientation of the board and rider. The puck system may also include one of the installation alignment tools described further below.

Figure 5B:
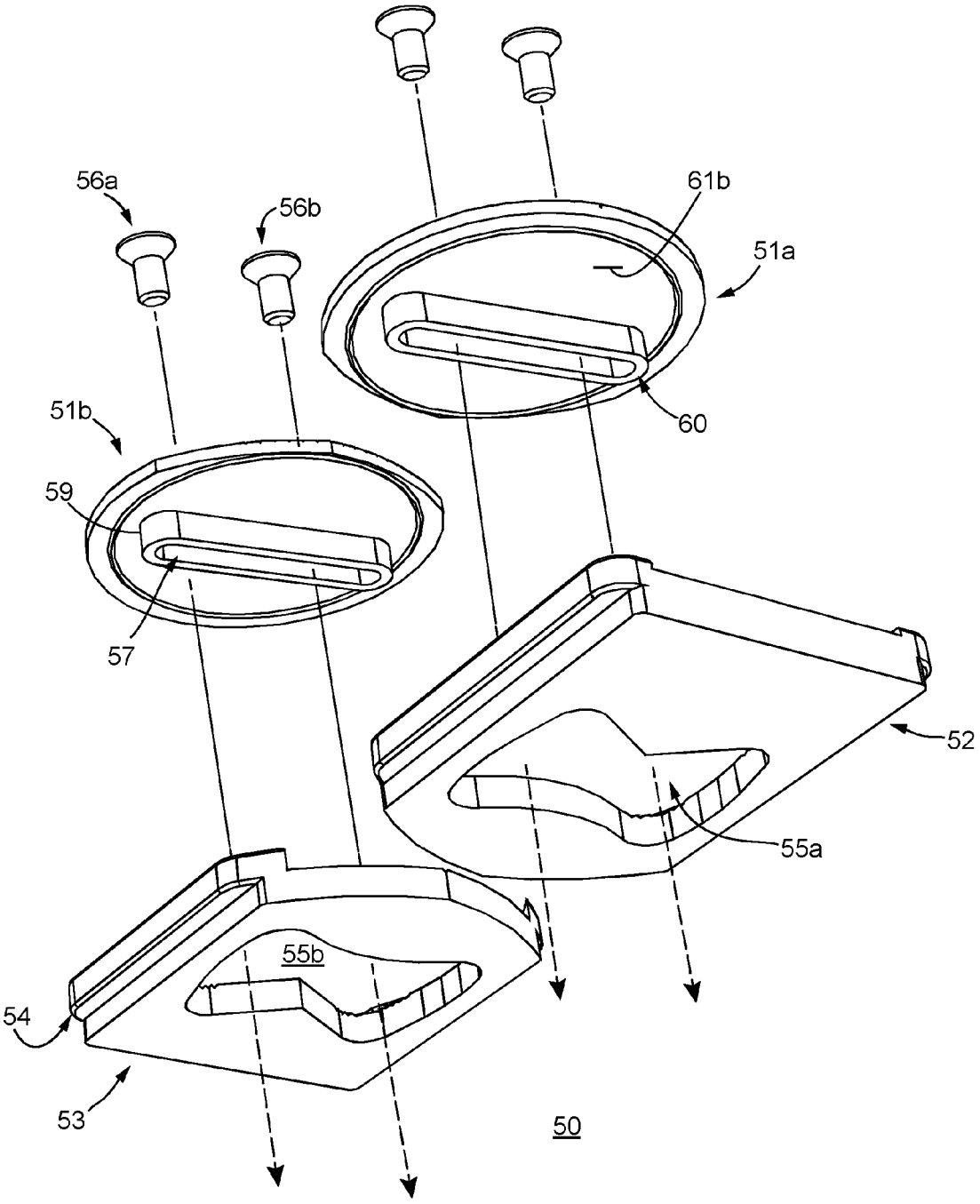
FIG. 5B is a bottom-up exploded view of the structure of a "puck" assembly of the invention.

FIG. 5B is a bottom-up exploded view of an adjustable puck assembly 50 of the invention. The mounting post 60 of flanged disk members (51*a*,51*b*) inserts into a retaining well or cutout (55*a*,55*b*) in the sliderblocks. The post 60 reinforces the slot 57, which is otherwise subject to stresses associated with the fasteners. Two screws (56*a*,56*b*) are mounted in the slot and threaded into the board. These fasteners secure the puck assemblies to the board surface. While preferred embodiments of the puck system are described here with respect to inserts in the board, the same hardware and puck systems may also be used by riders preferring slotted channels with "T-nuts" for positioning the pucks. Use of inserts has the advantage of greater board strength unless the board is reinforced around the slotted channels.

Figure 5C:
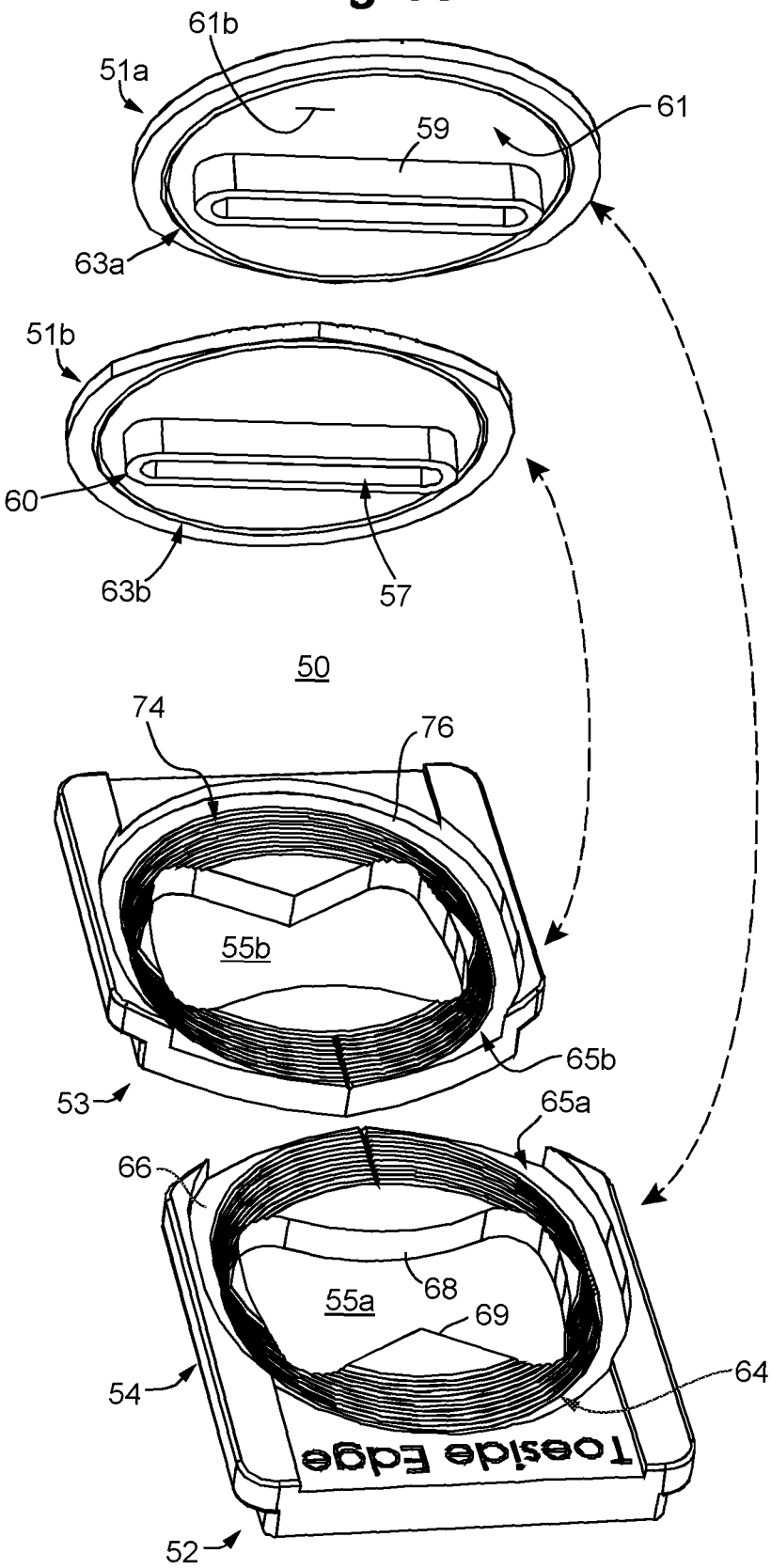
FIG. 5C is a clamshell exploded view of the assembly of a "puck" of the invention.

FIG. 5C is an exploded view demonstrating the assembly of a pair of "puck systems" of the invention. Each sliderblock (52,53) is provided with a butterfly cutout (55*a*,55*b*) that is generally hourglass shaped for receiving a post 60 with post wall 59 formed under the flanged disk (51*a*,51*b*) around the slot. Within the cutouts, cam 68 and anvil 69 control the seating and rotation of the flanged disk (as described more completely in FIGS. 10A through 10C). Not shown are threaded fasteners. Flanged disks (51*a*,51*b*) are interchangeable. In this view a male circular tooth or "detent ring" 63*a* is shown on the bottom surface 61*b* of cap plate 61 of the toeside flanged disk (51*a*); the detent ring engages one of a series of offset circular groove segments (patterned surface, 64) offset stepwise in the floor of the recessed mounting channels 65*a* on the top surface 66 of the toeside sliderblock 52. Detent ring 63*b* on the heelside flanged plate 51*b* functions in the same way in engaging toe patterned surface 74 in recessed channel 65*b* on the topside 76 of heelside sliderblock 53. This geometry was found to be strongest in resisting shear displacement of the pucks once locked down. The fineness of the adjustment is directly related to the number of female grooves and the dimensions of the grooves on the patterned surface 64, which may be closely spaced so as to permit a finer granularity of adjustment. However, other interlocking patterns, textures, or tooth geometries may also be used without departure from the scope and spirit of the invention. Similarly, in alternative embodiments, the patterned surface or other female feature may be placed on an underside of the flanged disk and the detent ring, tooth, or other male feature may be placed on a top side of the sliderblock.

Materials used in the puck system include metal on plastic as shown here, but may also include an all-metal construction, an all-plastic construction, and also coated metal embedments and composite members, for example. Different plastics may be used to achieve the desired material properties, rigid and stiff for the flanged disk and more flexible and spring-like for the sliderblock flanges 54. Reinforced plastics are generally used. Fibers of glass, carbon, or polyaramids such as polyparaphenylene terephthalamide having a high tensile strength are preferred so as to impart durability and failure resistance to the puck parts.

Wear resistance must also be considered. Advantageously, a plastic sliderblock may be somewhat pliant and more highly wear resistant, while the inner flanged disk may be stiffer and hence not as wear resistant. Metals such as aluminum provide a good balance of weight and stiffness. As currently practiced, the inventive puck systems are made with a glass fiber-filled nylon outer sliderblock and a locking flanged disk of machined aluminum. The cap plate of the flanged disk has a generally "mushroom shape" in cross-section such that the cap plate is generally flat with edges extending to and stiffening the flanges of the sliderblock. Reinforcement also includes a post having a wall depending from the cap plate on the underside. Contrary to some expectations, this combination has proven to resist failure caused by stretch-mediated yield or disengagement of the flanges from the cap plate, or by outright tearing. The parts of the puck assembly may be made by a molding process if desired, by a machining process, or by a combination of both as able to achieve the detail and dimensional tolerances for practice of the invention.

In another embodiment, the post 9 may be formed with a bottom gasket or may be dipped in a resilient coating material such as silicone rubber so as to protect the board surface, so as to conform to the board surface when compressed, and so as to increase frictional resistance against slippage.

Figure 5D:
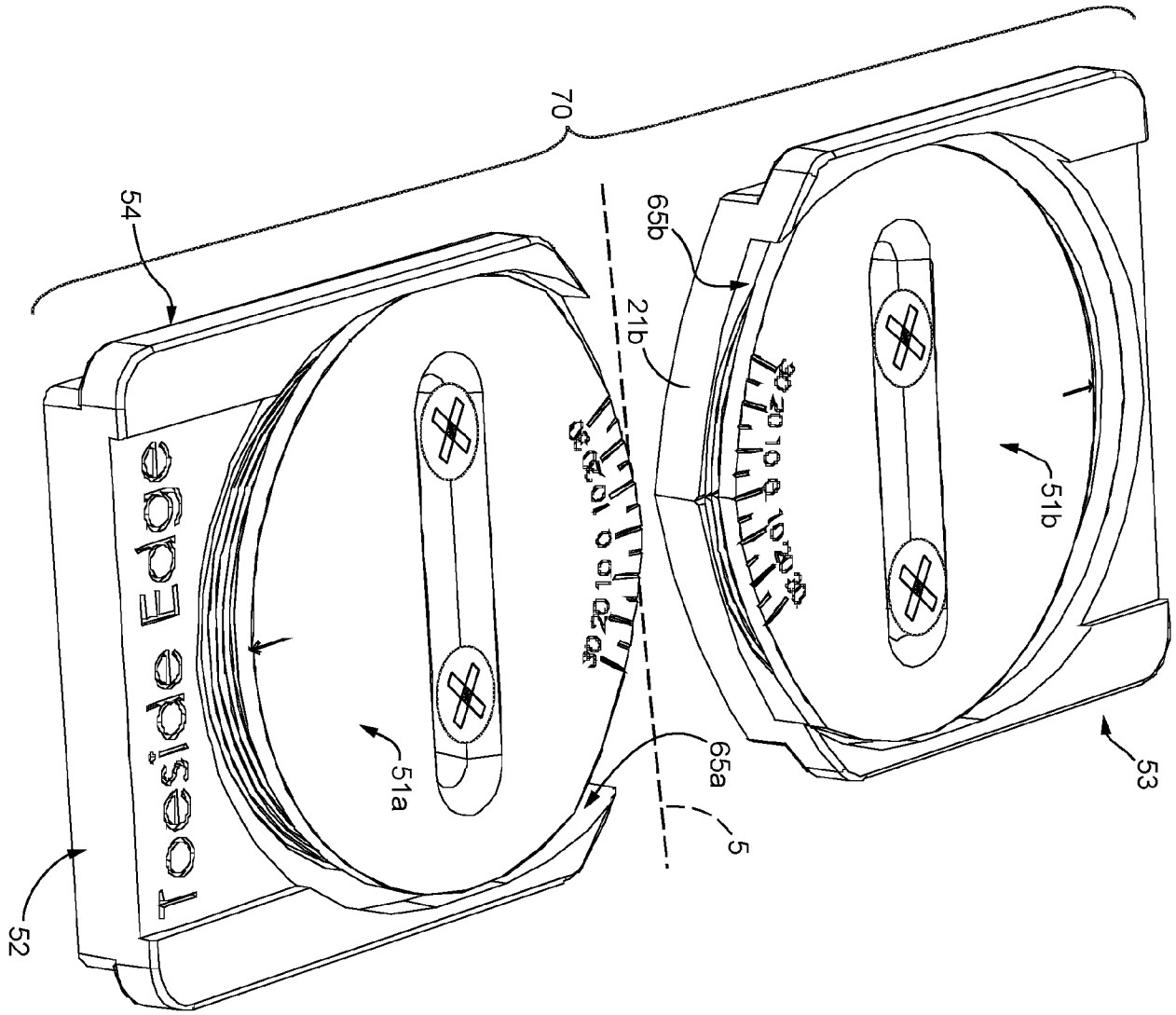
FIG. 5D is a perspective view of a fully assembled "puck pair" as used in ride mode with co-aligned flanges for spanning two ski members.

FIG. 5D is a perspective view of a fully assembled puck system 50 or "puck pair" 70 as used as a ride mode binding interface. Co-aligned external flanges 54 engage mated internal flanges of a boot binding baseplate and rigidly conjoin the two ski members. Recessed and tapered faces (21*a*,21*b*) on the opposing ends of the sliderblocks (52,53) were found to accommodate a more angular stance relative to centerline 5 when required. Removing excess material from the sliderblock faces eliminates the problem of exposed corners that could protrude over the edges of the ski members in ski tour mode. The flanged disks (51*a*,51*b*) are affixed to a board surface by fasteners as shown, but when loosened, the sliderblocks may be rotated or slideably repositioned along mounting channels (65*a*,65*b*), achieving a full three degrees of freedom in stance adjustment.

Figure 6A:
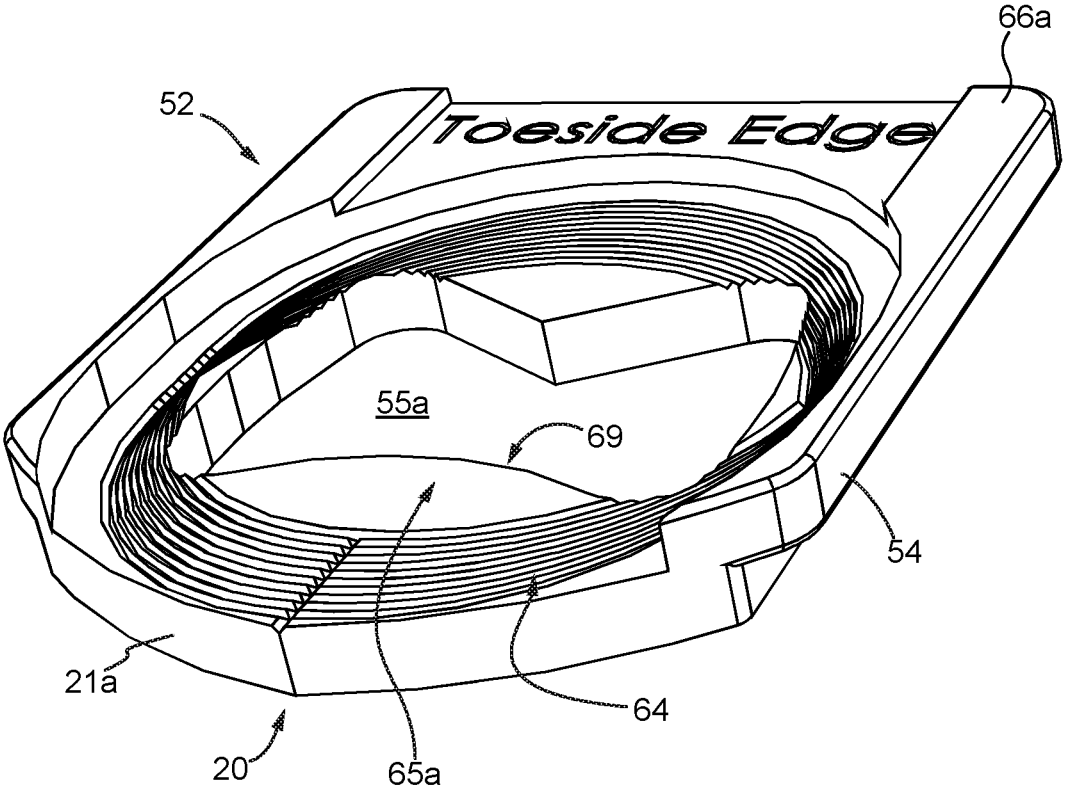
FIGS. 6A and 6B are top and bottom perspective views of a toeside sliderblock.
Figure 6B:
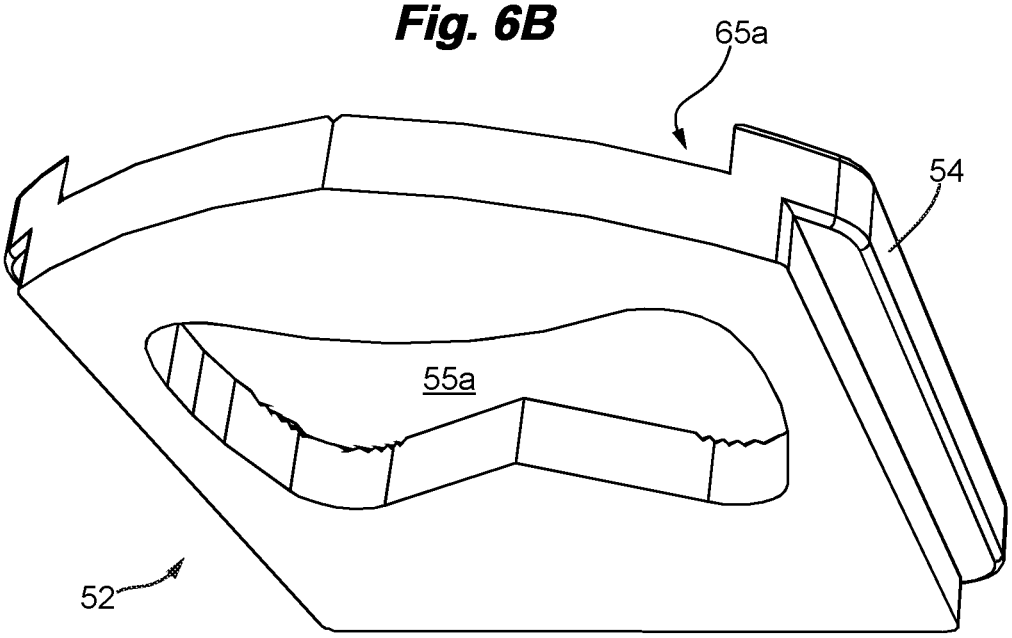

FIG. 6A is a top view in perspective of a "toeside" sliderblock 52. FIG. 6B is a bottom view in perspective of the toeside sliderblock. A central bottom cutout 55*a* in the shape of a biconcave polygon or "butterfly cutout" is shown. Also visible is a prominent external flange 54 superiolaterally positioned on either side of the block. Also marked is mounting channel 65*a* on top of the sliderblock: the channel is dimensioned and recessed for receiving a flanged disk and serving to guide the sliderblock in crosswise toe-to-heel centering. The channel is essentially an oblong circle in shape, having a length greater than a width and inscribing a semicircle at each end. Raised ledge 66*a* defines the border of the mounting channel recess 65*a* (as shown in FIGS. 5A, 5B, and 5C and in end view in FIG. 6E). The sliderblock is marked by a centerline reference 20, and tapered on front walls 21*a*. Patterned surface 64 includes stepwise offset circular grooves, the grooves providing rotational freedom of adjustment at multiple axes of rotation (according to the displacement of the sliderblock in the mounting channel).

FIG. 6C through FIG. 6H are isometric views of a "toeside" sliderblock 52 and reinforcing flanged disk 51*a*. The offset circular pattern 64 of female grooves in the top face 66 of the sliderblock is configured so that the opposing male detent ring 63*a* on the underside 61*b* of the flanged disk (FIG. 6G) fits into one and only one groove at a time, such that the position of the sliderblock may be advanced crosswise incrementally relative to slot 57 of the flanged disk—as determined by selection of one of a plurality of grooves available for receiving the detent ring 63*a* during the adjustment process. The grooves and detent ring are resistant to cross-threading, and are stronger than other patterns or surface roughness by virtue of the mated faces of the detent ring and grooves. However, other detent patterns may be used without departing from the scope and spirit of the invention. While the slot is generally positioned along a diameter line on the flanged disk, an off-center slot also may be used to achieve a larger range of adjustment, if needed for example for non-standard baseplates. If so provided, the flanged disk may be rotated 180 degrees to add extra range for sliding block positioning (insofar as the post and slot are biased toward one pole of the flanged disk) and trimmed if needed. As shown, the opposing faces of the two pucks are trimmed 21*a* so that there are no parts of the sliderblock or the cap plate that project past the centerline seam of the board with steeper stance rotations. Any projecting surface of the sliderblocks (or flanged disks) would be undesirable in ski tour mode.

End view FIG. 6E of the sliderblock 52 better shows superiolateral raised flange flats 54 with underside lip 54*a* on the sliderblock and recessed mounting channel 65*a* for receiving toeside flanged disk 51*a*. End view FIG. 6H of the flanged disk 51*a* shows that beneath the cap plate 61 of the flanged disk is a wall section 59 of slot riser post 60 in elevation view (FIG. 6H) that surrounds and deepens the open slot 57 visible in FIGS. 6F and 6G. Post wall 59 follows the outline of the slot and adds stability. Pinch points in the cutout 55*a* stabilize the position and rotation of the post over a defined range of rotation and offset relative to the sliderblock. The flanged disk may be described as having a flanged cap plate and a reinforced post attached to the underside of the plate, and is thus generally mushroom-shaped when upright. The reinforced post 60 is hollowed out to form wall 59 defining slot 57 that extends through the post and through the cap plate, as used for receiving board fasteners. Generally slot 57 upper lip is beveled to receive indented flathead screws for affixing the puck to the board and may be scalloped on the bevel to prevent slippage. Detent ring 63*a* is shown in plan view in FIG. 6G and in profile in FIG. 6H.

Figure 7A:
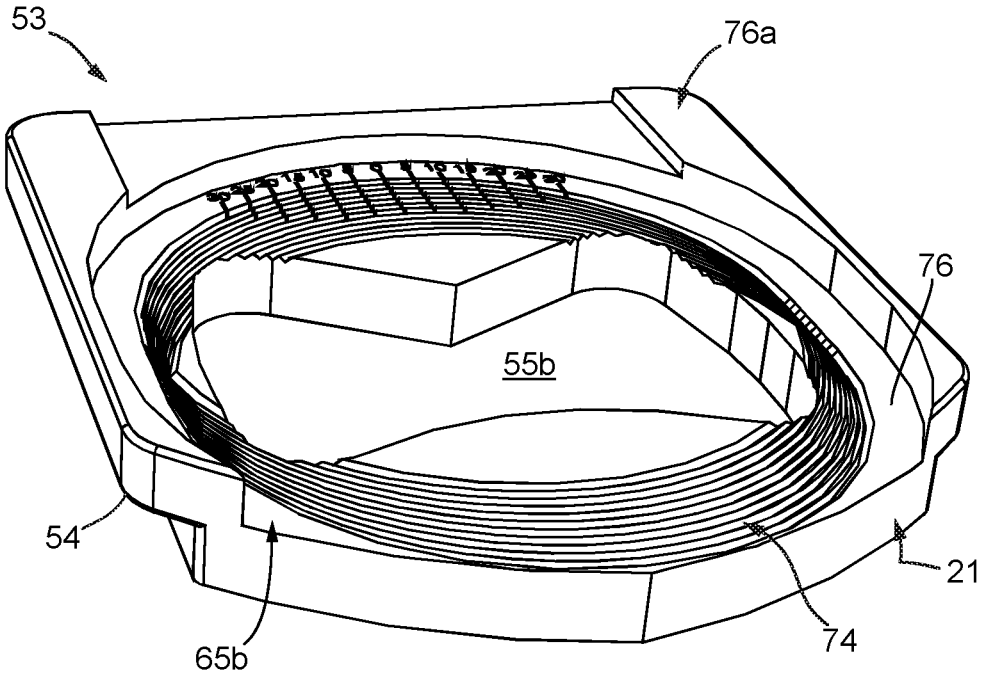
FIGS. 7A and 7B are top and bottom perspective views of a heelside sliderblock.
Figure 7B:
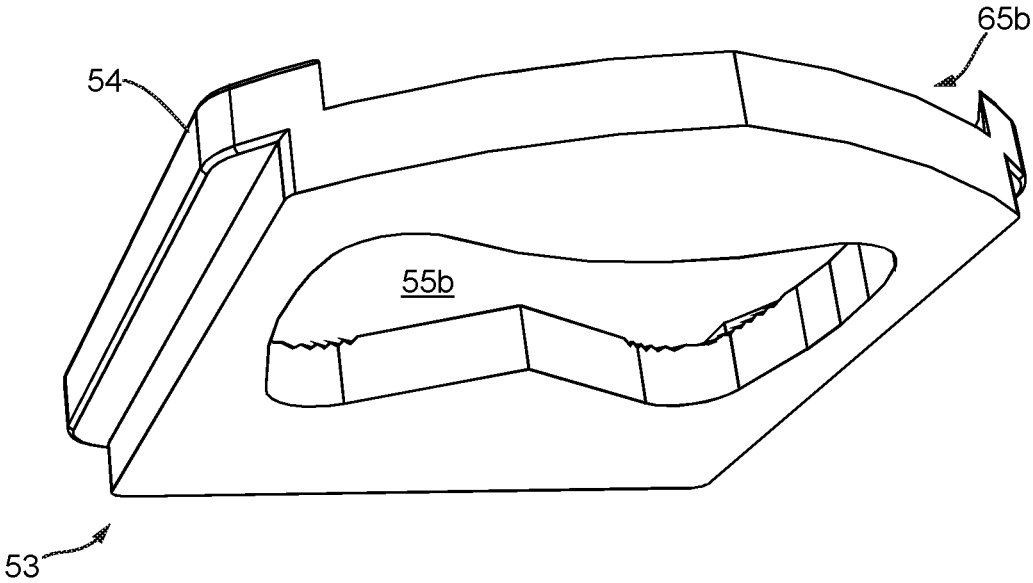

FIG. 7A is a top view in perspective of a "heelside" sliderblock 53. FIG. 7B is a bottom view in perspective of heelside sliderblock 53. Details of central bottom cutout 55*b* in the shape of a biconcave polygon or "butterfly cutout" are shown. Also visible is a prominent superiolateral external flange member 54 on either side of the block. Also marked is a mounting channel 65*b* formed on top 76 of the heelside sliderblock, the channel for receiving the heelside flanged disk 51*b* and for guiding the sliderblock in crosswise toe-to-heel centering. The channel is essentially an oblong circle in shape, having semicircular ends and an extended length to accommodate a plurality of offset circular grooves 74. Raised ledge 76*a* defines the recessed mounting channel 65*b* (also depicted in FIGS. 5A, 5C and 7C, 7E).

FIG. 7C through FIG. 7H are isometric views of a heelside sliderblock 53 and flanged disk 51*b*. The offset circular pattern 64 of grooves in the top face 66 of the heelside sliderblock is configured so that the opposing detent ring 63*b* on the underside 61*b* of the cap plate (FIG. 7G) fits into one and only one groove at a time, such that the position of the sliderblock may be advanced incrementally relative to its fastener mount according to selection of one of a plurality of grooves 74 available for receiving the detent ring. The grooves and detent ring are resistant to cross-threading, and are stronger than other patterns or surface roughness by virtue of the mated faces of the ridge and grooves. However, other detent patterns may be used without departing from the scope and spirit of the invention.

While the slot is generally positioned along a diameter line on the flanged disk, an off-center slot may also be used to achieve a larger range of adjustment, if needed. If so provided, the flanged disk may be rotated 180 degrees to add extra range for sliding block positioning (insofar as the post and slot are biased toward one pole of the flanged disk) and trimmed as needed. The advantage of so doing is in accommodating larger (or smaller) boot binding baseplates. As shown, the opposing faces of the two pucks are trimmed 21*b* so that there are no parts of the sliderblock or the cap plate that project past the centerline seam of the board with steeper stance rotations. Any projecting surface of the sliderblocks (or flanged disks) would be undesirable in ski tour mode.

End view FIG. 7E of the heelside sliderblock 53 also shows raised external flanges 54 with underside lip 54*a* on the sliderblock and recessed mounting channel 65*b* for receiving toeside flanged disk 51*b*. End view FIG. 7H of the flanged disk 51*b* shows that beneath the cap plate 61 of the flanged disk is a wall section 59 of slot riser post 60 in elevation view (FIG. 7H) that surrounds and deepens the open slot 57 visible in FIGS. 7F and 7G. The post wall 59 follows the outline of the slot and adds stability. Pinch points in the cutout 55*b* stabilize the position and rotation of the post over a defined range of rotation and offset relative to the sliderblock. The flanged disk may be described as having a flanged head and a reinforced post attached to the underside of the plate, and is thus generally mushroom-shaped when standing on end. The reinforced post 60 is hollowed out to form wall 59 defining slot 57 that extends through the post and through the cap plate, as used for receiving board fasteners. Generally slot 57 upper lip is beveled to receive flathead screws for affixing the puck to the board and may be scalloped to prevent slippage. Detent ring 63*a* is shown in plan view in FIG. 7G and in profile in FIG. 7H.

FIG. 8A is a perspective view of toeside puck 52 of the invention and section cutline A-A. FIG. 8B is a center cross-section at A-A through the puck assembly. Shown in section are plastic sliderblock 52 with center cutout 55*a*, metal flanged disk 51*a* with beveled center slot 57 and post 60. Also shown is a patterned surface 64 in the recessed mounting channel 65*a* of the toeside sliderblock and a mating detent ring 63*a* elevated on the underside of the flanged disk near the outside edge; the two features together functioning as a variable-position detent mechanism. Adjustment using the detent mechanism is illustrated in the following figures.

Figure 9A:
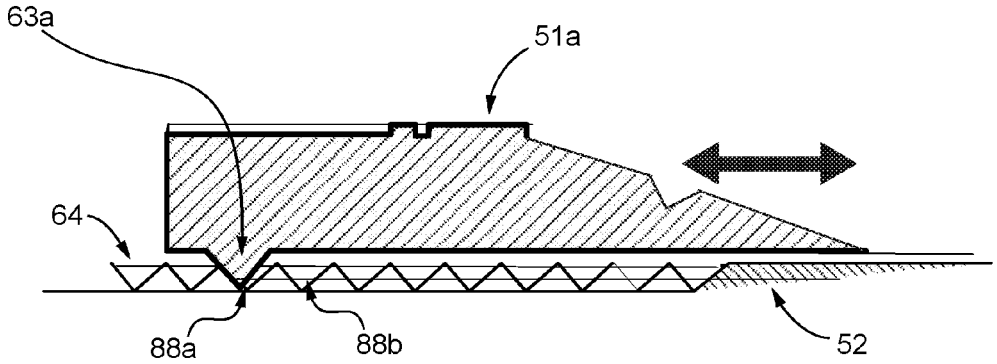
FIG. 9A is a detail view taken at section A-A of FIG. 8A.
Figure 9B:
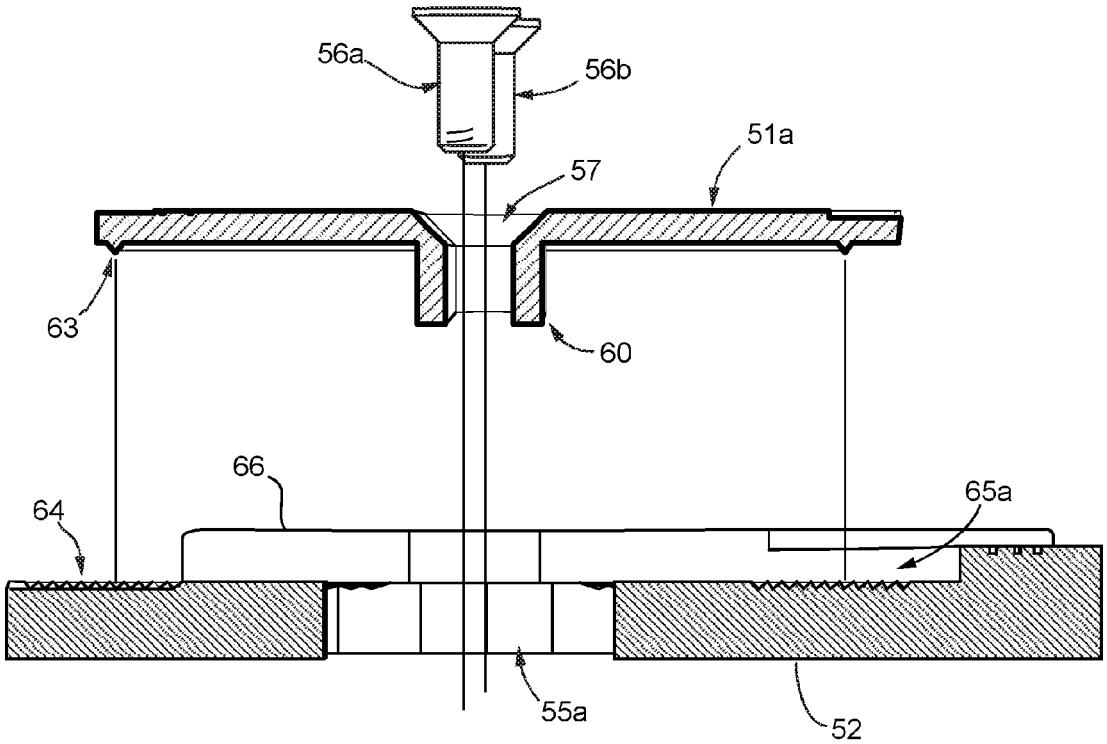
FIG. 9B is an exploded view showing the mounting slot and sliderblock cutout in cross-section.

FIGS. 9A and 9B are cross-sectional views taken at section A-A of FIG. 8A. FIG. 9A is a magnified view of the male tooth or ridge of detent ring 63*a* in positional engagement with grooves of patterned surface 64 of an underside disk member 51*a*. The bold arrow indicates cross-wise adjustment by lifting and moving the detent ring from one groove 88*a* to another 88*b*, for example. For each adjustment increment, the male detent element engages one of a plurality of mated female grooves of a toeside sliderblock 52 and is secured in place using fasteners as described earlier. Female detent grooves (88*a*,88*b*) have a sawtooth appearance in section but in fact are circles. Because the detent elements are circular ridges and grooves, the sliderblock retains its capacity to pivot around a rotational axis formed by the riser post and slot (60,57) in the center "butterfly" cutout 55*a* of the toeside sliderblock. The post and slot serve as a rotational axis because the flanged disk geometry and position is fixed by the fasteners in the slot; it is the sliderblock that moves.

As shown in FIG. 9B in exploded cross-sectional view of the toeside puck assembly, the cross-wise adjustment is made from a selection of female grooves on the patterned surface 64. The sliderblock is formed with a recessed channel 65*a* and the flanged disk 51*a* is seated and locked in the mounting channel when the desired toe-to-heel distance is established and the pucks are centered relative to the centerline long axis of the board. Once tightened down with fasteners (56*a*,56*b*), the mechanical stack of the puck assembly forms a solid support for engaging the boot binding baseplate and the rider thereon.

The detent geometry (of a male ring tooth seated in one of a plurality of female grooves) has a high level of resistance to shear that could otherwise result in slippage or deterioration of the mated surfaces. Other patterned surfaces, such as raised tetrahedrons, diamonds, or one or more ridged "Vee" shapes may be used, but these surfaces may be more subject to shear and less resistant to wear. Individual teeth or shorter gripping segments may be used, but again will be less resistant to wear and more failure prone when subjected to forces acting on the rider and board. Advantageously, circular grooves promote easy rotational adjustment.

The added utility of this design is that rather than there being one round "home" for the flanged disk as available with conventional puck design, there are a plurality of female seats in the sliderblock for the flanged disk with detent ring (63*a*,63*b*). From a geometrical standpoint this unlocks the stance options in terms of angle, foot placement and toe-to-heel centering on the board. Each adjustment corresponds to different degrees of freedom of the puck and now each adjustment may be addressed independently without compromise. "Toe-to-heel centering" is a technical advance in the art and a solution to the problem of stance adjustments necessitated by boot angle and by irregularities in the placement of fasteners in conventional boards. Future generations of board riders will be able to use a puck system with binding baseplates having dimensions not strictly constrained by the standardized sliderblock geometry currently available. In fact, the boot binding baseplate may be resized to fit individual sizes of feet and yet remain compatible with a standard ride mode interface.

In a further improvement, an installation tool may be provided to aid in making adjustments individually for a rider. This tool is fitted to the edges of the board and to the pucks so that the required puck rotation, foot position and stance, and cross-centering may be dialed in before tightening the flanged disks to the board. Further description is provided below.

Thus the invention is also a method for optimizing ride mode stance and boot binding position. The method may be described briefly as involving conventional steps—plus a step for centering the rider's stance toe-to-heel crosswise on a board, which comprises: a) providing a toe puck and a heel puck, each the puck having a flanged disk recessed in a mounting channel on top of a sliderblock, wherein a bottom surface of the flanged disk and a top surface of the channel comprise a plurality of engageable detents; b) affixing the sliderblocks to a board by inserting the flanged disks therethrough and fastening the flanged disks loosely to a board with threaded fasteners; c) adjusting the sliderblocks on the flanged disks so as to center the boot binding crosswise on a board; and finally, d) tightening the fasteners to secure the sliderblocks in a cross-centered position. The method may also include an adjustment of the sliderblocks on the flanged disks so as to define an "end-to-end" distance for securing a binding baseplate in locking contact with an outside end of the heel puck and a toe lock in contact with a toeside end of the toe puck. These steps may be performed with an installation tool provided to the dealer or end user if desired.

Figure 9C:
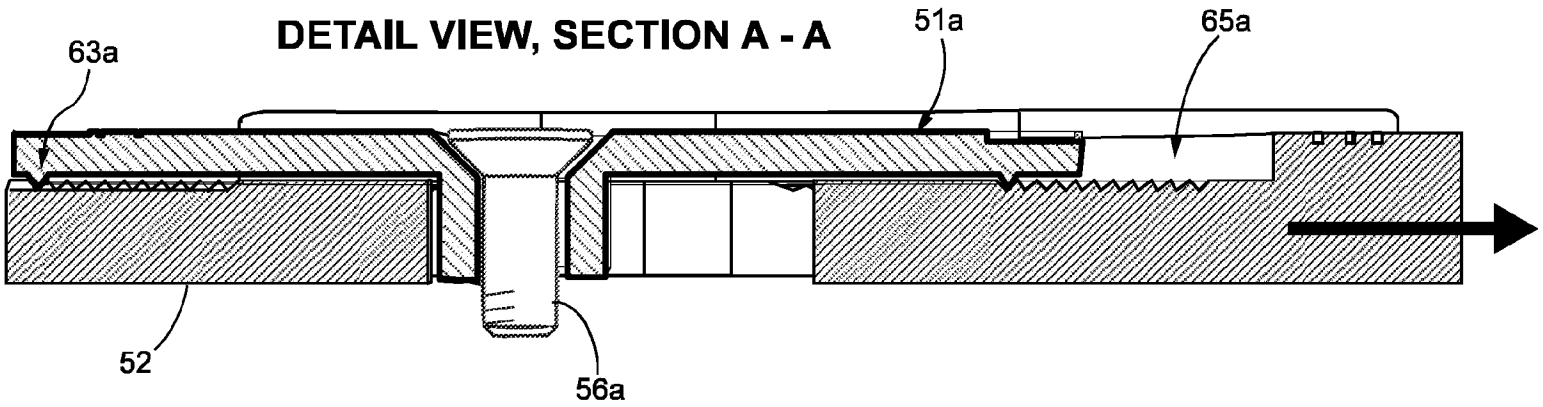
FIGS. 9C and 9D are action views taken at section A-A of FIG. 8B, where the puck flanged disk is repositioned from an endwise leftward position (FIG. 9C) to a centerwise rightward position (FIG. 9D).
Figure 9D:
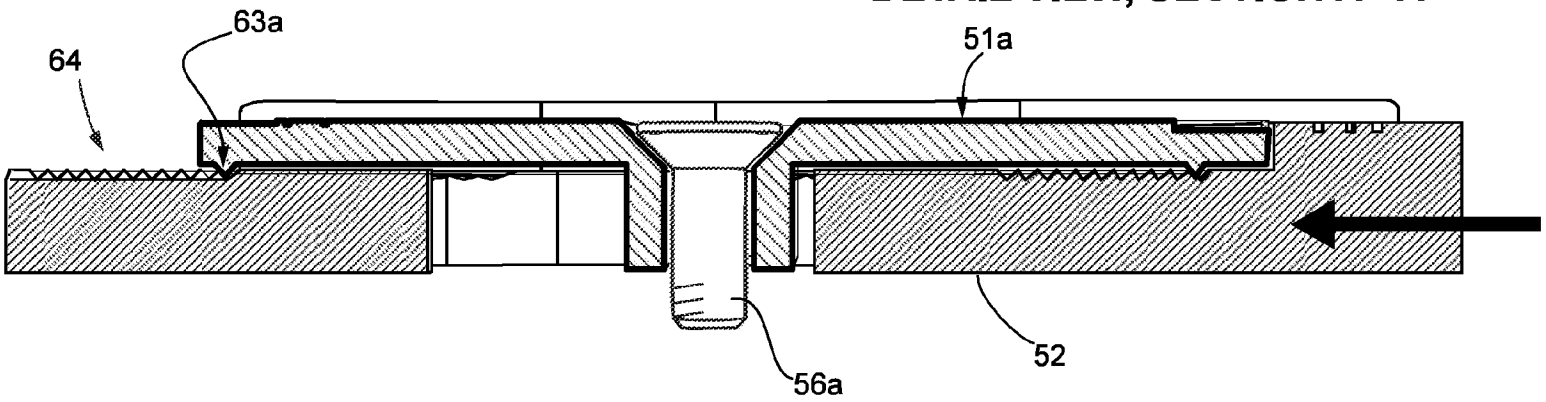

FIGS. 9C and 9D are views taken at section A-A of FIG. 8A, where the toeside sliderblock 52 (for example) is repositioned on a flanged disk 51*a* from an endwise leftward position (FIG. 9A) to a centerwise rightward position (FIG. 9B) relative to the puck flanged disk. The sliding motion (bold arrows) occurs in recessed channel 65*a* of the sliderblock. The recessed channel floor is patterned with detent elements 64 for engaging a male detent ring 63*a* of the flanged disk. This centering adjustment as currently practiced enables the user to move and reseat the sliderblock under the flanged disk over a range of about a half inch. This is sufficient to adjust the end-to-end separation of the pucks according to a best fit of the boot binding baseplate and to position the puck assembly in the center of the board equidistant from the board lateral edges. As the boot binding is angled, stance angle increases, and so to the distance between the pucks also increases according to a trigonometric function of the angle. As a further advantage of the inventive puck system, the increased boot angulation can be compensated to maintain a constant separation distance between pucks by the variable-detent mechanism adjustment shown here, in combination with selection of mounting holes.

To illustrate, for pucks set perpendicular to the centerline axis of the board, the separation distance between the two pucks might be about 3.34 inches (alternatively the end-to-end distance may be about 7.625 inches). But at 30 degrees from perpendicular, the puck separation distance would increase to 3.86 inches (about 15%), preventing effective use of a toe locking pin 34. By providing both sliderblock members with a capacity to be displaced or offset relative to their fasteners (56*a*, 56*b*), this problem is overcome. Each sliderblock is provided with about a half inch of "crosswise adjustment" under its flanged disk. This range of adjustment is sufficient to overcome the problem of angle geometry and also can overcome any irregularities in board fastener placement such as variation or bias in fastener-to-edge distance. In this way, a versatile and accurate "toe-to-heel centering" method is realized.

Irregularities in splitboard "insert" (female threaded fastener) positions arise during fabrication of the board, and cannot be eliminated entirely. Boards are generally made of wood, metal and fiberglass, for example, by a process of lamination and shaping such that hole placement will have a tolerance of at least ±0.01 inches, generally more. Finishing processes involve use of a belt sander to polish the board edges and one or more coatings, making it even harder to ensure a consistent distance between the inserts and the board seam (in a splitboard). Each manufacturer will have a slightly different process such that boot binding interfaces cannot be centered toe-to-heel relative to the board edges and centerline without a puck system that allows the user to make a final graded adjustment.

Figure 10A:
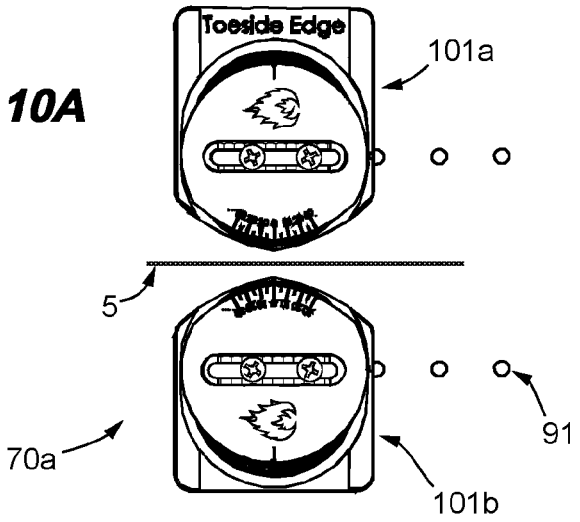
FIGS. 10A, 10B, and 10C are views demonstrating rotational angular adjustments.
Figure 10B:
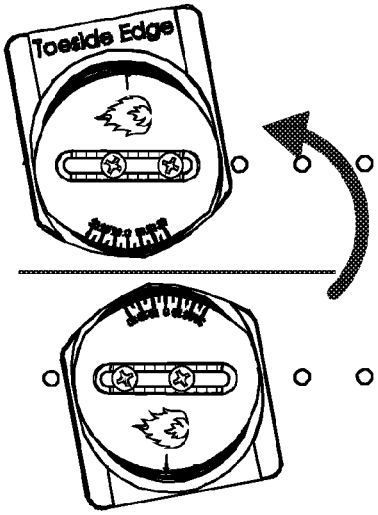
Figure 10C:
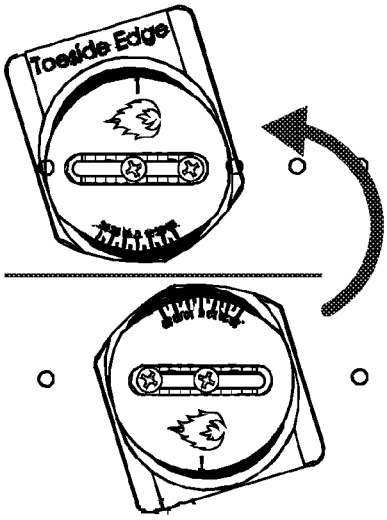

FIGS. 10A, 10B, and 10C are views of rotational angular adjustments (bold arrows) made in positioning a pair 70*a* of puck assemblies (toeside puck assembly 101*a*, heelside puck assembly 101*b* with flanged disks) on the surface of a splitboard (shown here as having two rows of six pre-tapped holes 91). In combination, the two puck assemblies make up a ride mode interface 100 for one foot of a rider. The flanges of the sliderblocks of the pair are essentially parallel for receiving a rider's boot binding. A similar pair is mounted for the back foot of the rider. Various theta-angles (θ) are shown for demonstration. Centerline 5 is shown for reference.

Angular boot binding adjustments may be made by turning the sliderblock clockwise or counterclockwise relative to the disk slot before tightening the threaded fasteners. Angles may be reversed so as to be used in either a positive or a negative stance and with either foot forward. At all boot binding angulations as mounted on the puck system angulations, the flange ledges 54 of the sliderblocks of the pair are essentially parallel for receiving a first binding baseplate. A similar pair is mounted for a second binding baseplate to receive a second foot, each baseplate having fittings including straps and supports for receiving a boot as shown in FIG. 12D.

Figure 11A:
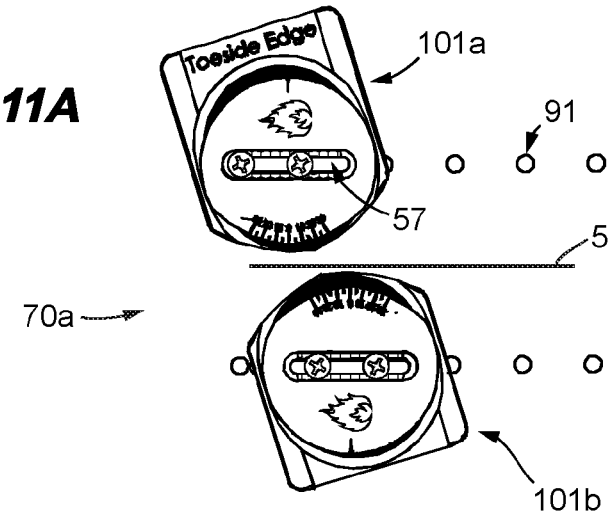
FIGS. 11A, 11B, and 11C are views demonstrating longwise stance adjustments.
Figure 11B:
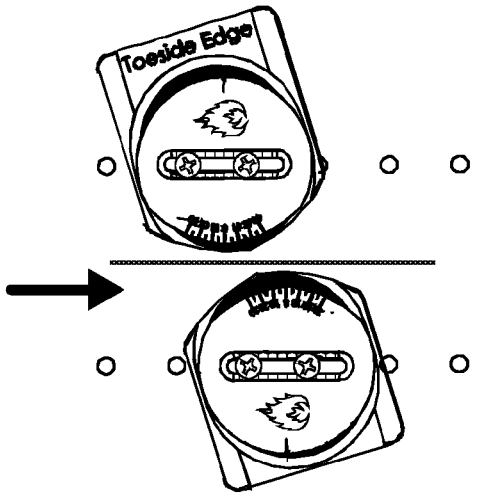
Figure 11C:
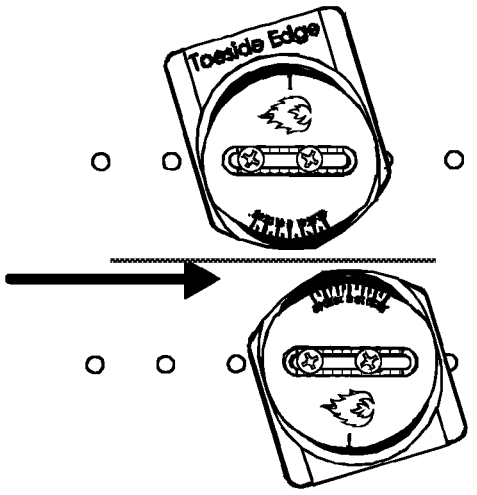

FIGS. 11A, 11B, and 11C are views of longwise stance adjustments (bold arrows) made in positioning a pair 70*a* of puck assemblies (101*a*,101*b*) on the surface of a splitboard (shown here having two rows of six pre-tapped holes, 91). In combination the pair of puck assemblies make up a ride mode interface for one boot of a rider. Each pair of threaded fasteners (FIG. 9B: 56*a*,56*b*) is mounted in slot 57 so as to lock the pucks in the desired position. Longwise coarse adjustments are made by selecting a pair of holes 91; finer adjustments are made by selecting a tooth position of the threaded fasteners in the slot 57. Exemplary scalloped dentations 57*a* are illustrated with more clarity in FIG. 17C, and are well suited to the fasteners of FIG. 9B, but the invention may be practiced with a variety of slot detents.

Figure 12A:
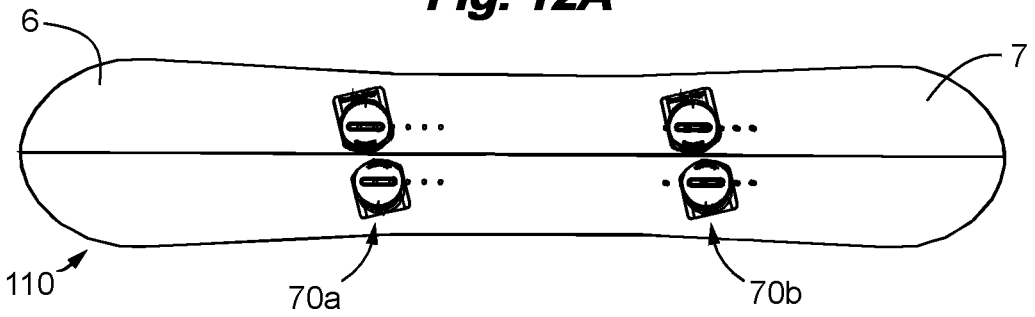
FIGS. 12A and 12B are views showing selected stance angles.
Figure 12B:
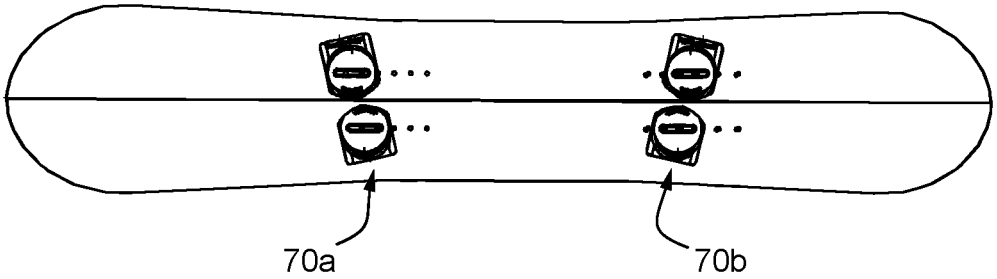

FIGS. 12A and 12B are views of a board outfitted with two pairs of puck assemblies (70*a*,70*b*), one for each foot of a rider, showing different stance angles. In these figures, assuming the nose 6 of the board is the leftward end and the tail 7 rightward, then both the bindings in FIG. 12A have a "positive stance angle", and the tail binding in FIG. 12B has a "negative stance angle". Riders may adjust their stance starting from either footing preference.

Figure 12C:
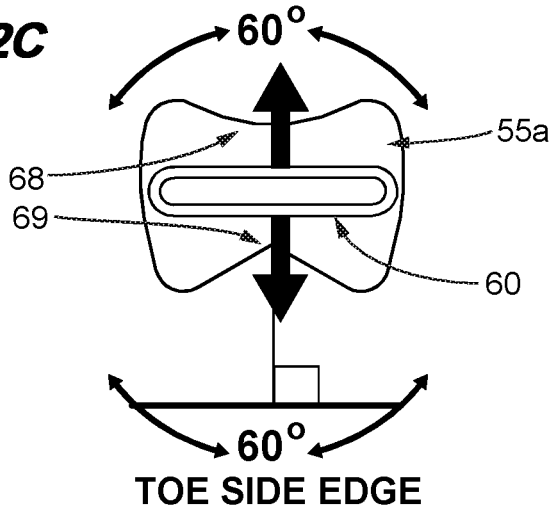
FIG. 12C is a schematic view demonstrating the sixty degree range of motion of the post in the cutout of the sliderblock.
Figure 12D:
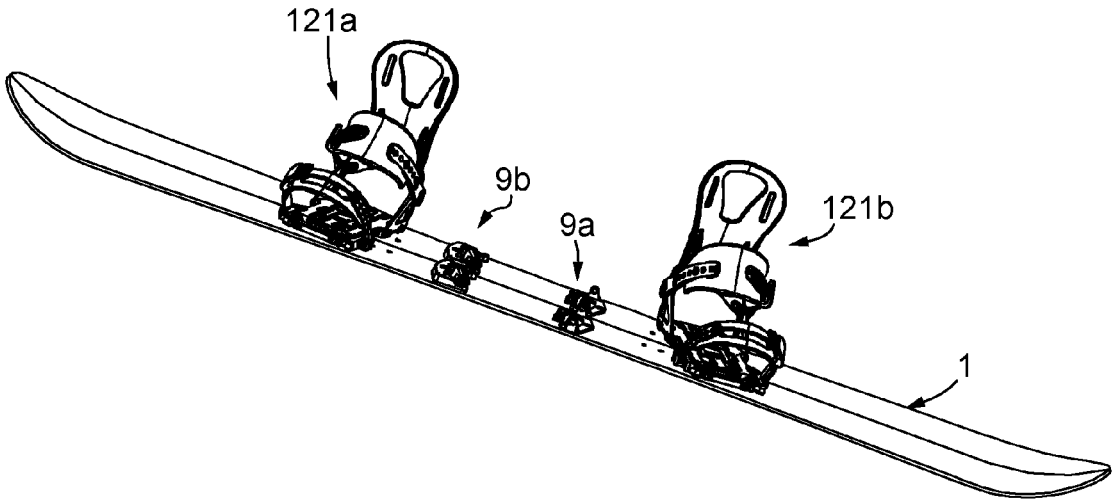
FIG. 12D is a perspective view of a fully assembled splitboard, including splitboard interface and boot bindings.

FIG. 12C is a schematic view demonstrating the range of motion of the post 60 in the butterfly cutout 55*a* of the sliderblock. A diagram showing a simplified toeside assembly is taken for illustration. The toeside edge is marked. Cutout 55*a* allows rotation of post 60 clockwise and counterclockwise in combination with linear motion crosswise (i.e., perpendicular) to the long axis of the board. Cam 68 and anvil 69 stabilize and position the post in the cutout. Rotation of sixty degrees relative to the toeside edge is achieved. In other words, the butterfly cutout in the sliderblock is configured for receiving the post of the flanged disk and allowing a range of motion of the post of about 0.5 inch in the internal voidspace of the cutout. The rotational freedom of the post in the cutout is about ±30 degrees relative to the long axis of the board, an angle greater than the range typically required by riders. Riding at an angulation of twenty-five degrees is generally considered to be an extreme position. Rotation and cross-wise adjustments are independent in the puck systems of the invention.

A representative butterfly cutout 55*a* is perhaps best described by its shape as drawn, and is shown in FIG. 12C in a two-dimensional view. The cutout may be formed by laser cutting, by milling, or by molding in the case of thermoset plastics, and is shaped to allow the sliderblock sixty degrees of turning freedom when mounted under the metal disk. The cutout walls capture the post walls between what is termed here an anvil surface and a cam surface, the post having a range of travel of about 0.5 inch in the cutout. The size of the cutout is minimized so as to ensure a larger supporting contact surface between the two parts; preserving sliderblock mass for stiffness. The flanged disk has perimeter contact with the raised lip of the mounting channel over the full range of possible adjustments.

The cutout shown here has the shape of a biconcave polyhedron having four curved inside faces and two straight inside faces, where all unions between the sides are radiused except at the vertex of the triangle. The "toe end" (opposite the "heel end") of the sliderblock is at the end of the block defined by the isosceles triangle or anvil 69 of the cutout. The sharp tip of the anvil pins the post wall against the soft curve of the opposite cam wall 68 while permitting angular rotation over the desired range.

Figure 12E:
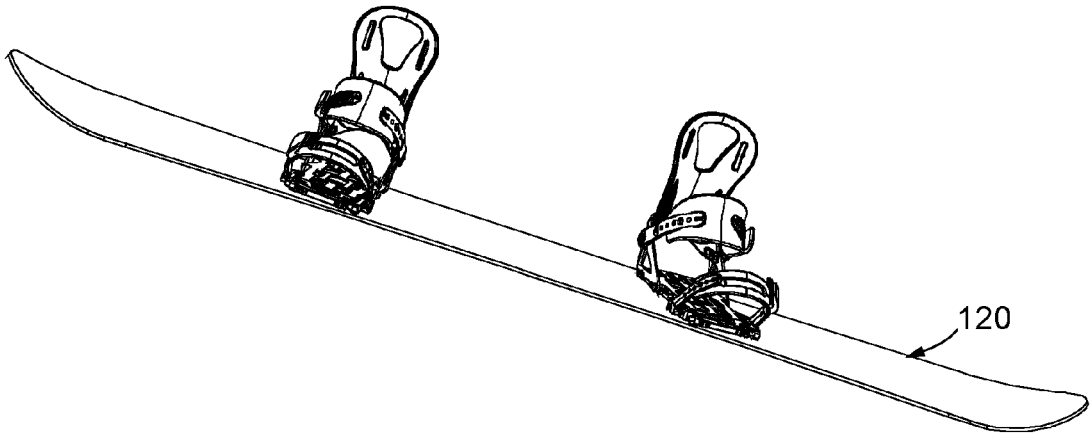
FIG. 12E is a perspective view of a snowboard, including boot bindings and a ride mode interface using the puck system of the invention.

FIG. 12D is a perspective view of a fully assembled splitboard 1, including boot bindings (121*a*,121*b*), including straps and highbacks, mounted on the puck system of the invention. Also shown at about center is a ski tour interface having a toe pivot 9*a* and a heel rest 9*b*. FIG. 12E is a perspective view of a snowboard 120, including a ride mode interface (70*a*,70*b*) and boot bindings mounted on the puck system of the invention. A snowboard is also termed a "solidboard" (in contrast to a "splitboard"). The puck systems of the invention may be used on either board type.

Figure 13:
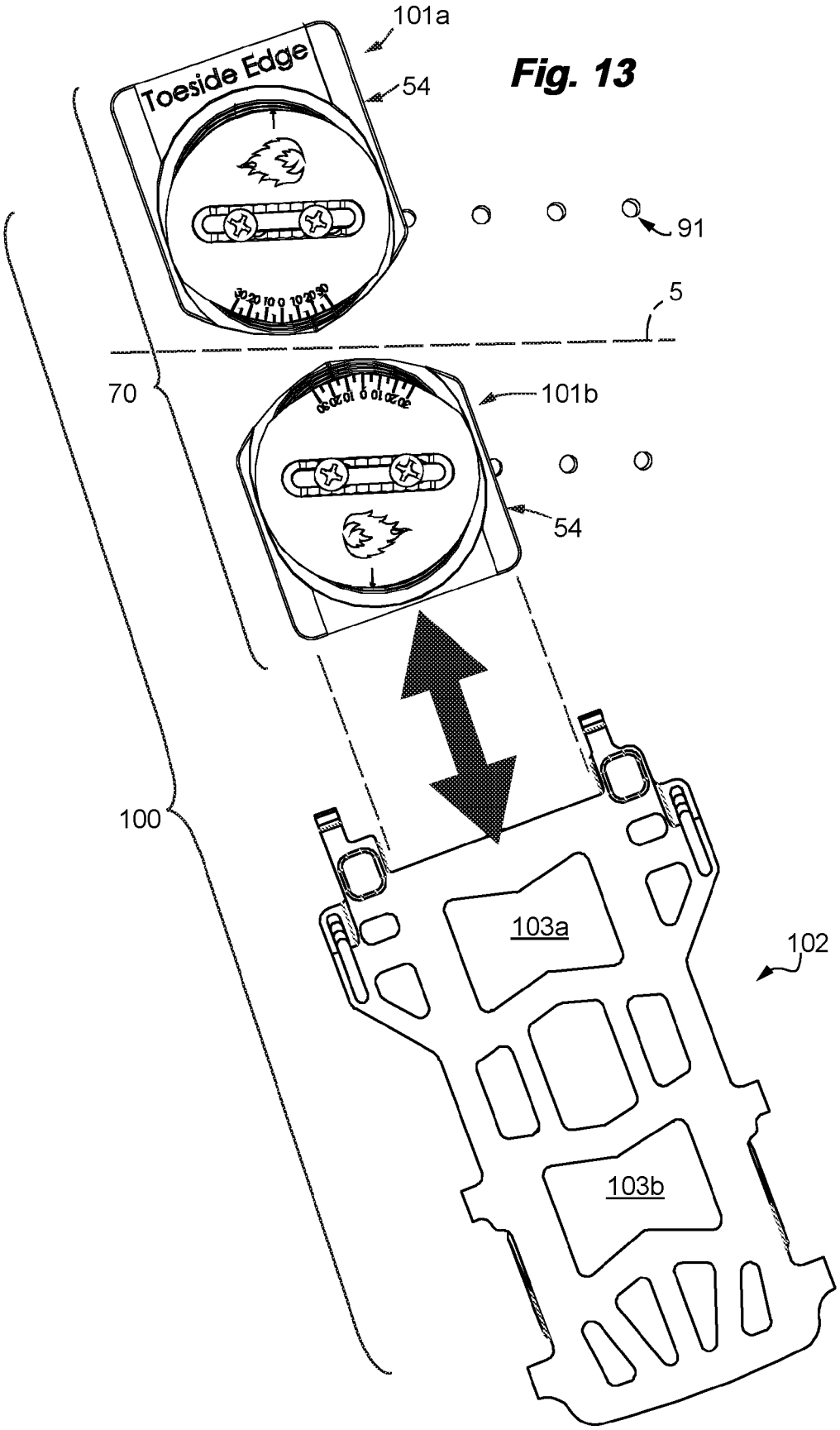
FIG. 13 is an action view showing a splitboard interface with two puck assemblies for receiving a flanged binding baseplate.
Figure 16A:
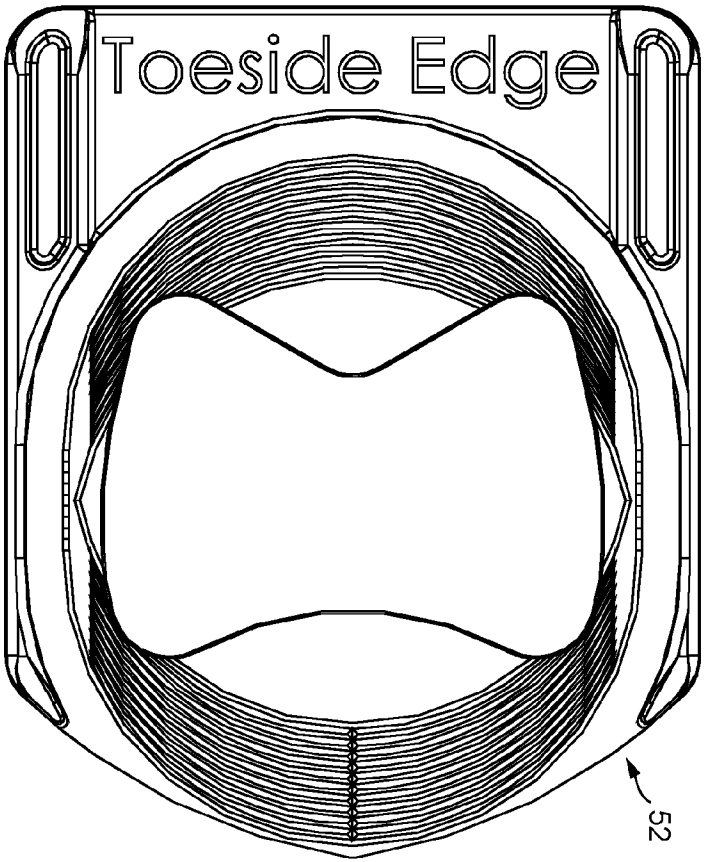
FIGS. 16A, 16B, 16C and 16D are components of an exemplary kit for practicing puck alignment methods when used with a puck system of the invention.
Figure 16B:
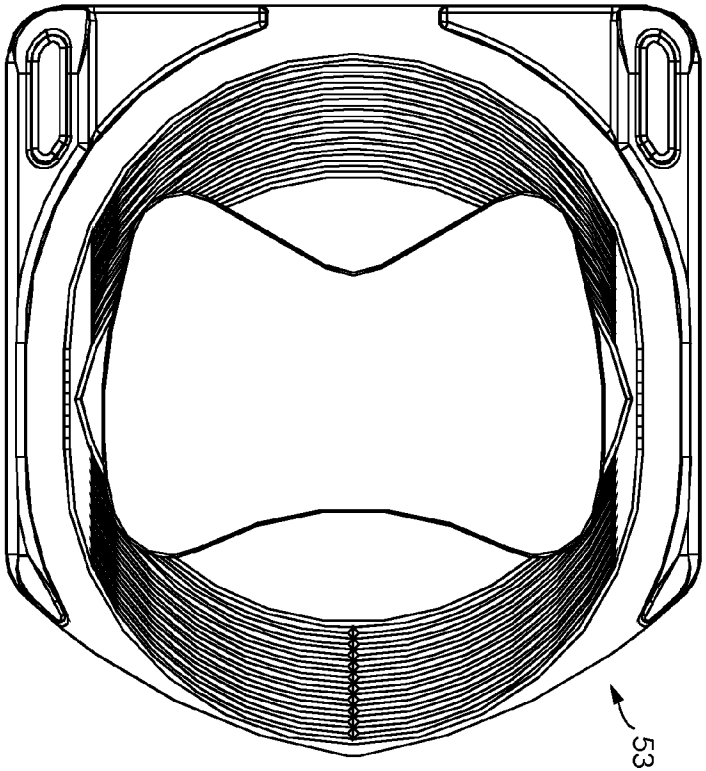
Figure 16C:
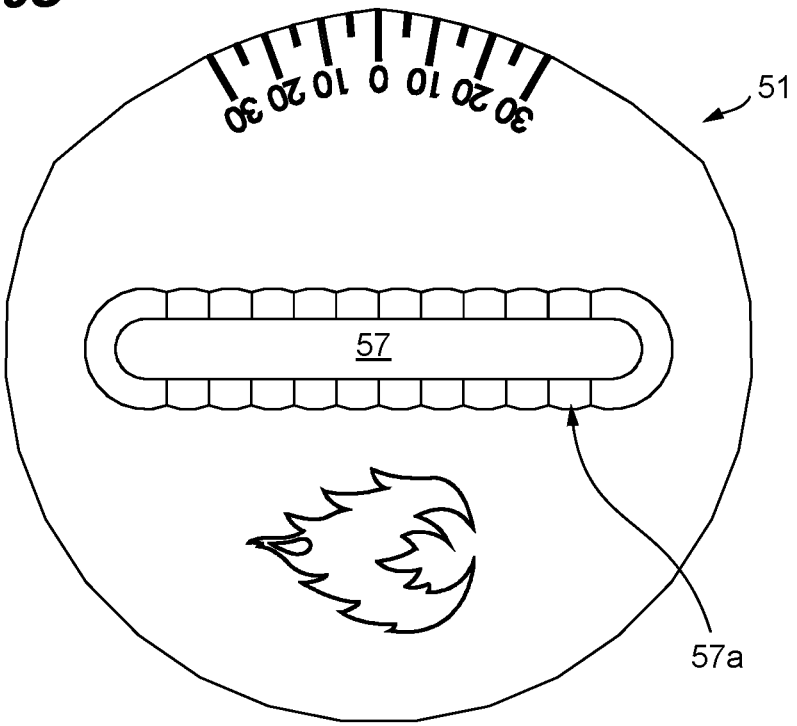
Figure 16D:
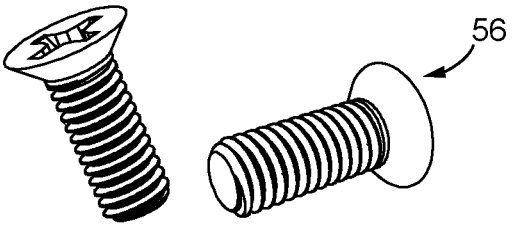

FIG. 13 shows a partial board interface 100 (a single boot interface is shown) with two puck assemblies (101*a*,101*b*) receiving a flanged boot binding baseplate 102. In combination, these puck assemblies form a mounting interface with boot binding baseplate for receiving a first boot.

In board ride mode, a pair of blocks, termed "sliderblocks" (52,53), are mounted on each of the ski members. Preferred boot bindings (30,102) include underside internal flanges for slidingly engaging mated parallel external contralateral flange edges (here termed the "slider track") of the sliderblocks so as to rigidly conjoin the ski members at each boot. Added conjoining means may be used to further brace the splitboard seam in solidboard configuration. A "flanged disk" (51*a*,51*b*) seats in a butterfly cutout (55*a*,55*b*) in each sliderblock to provide reinforcement. The flanged disk is fitted with a flat "cap plate" 61 that extends, at least in part, across the top face of the sliderblock and an underside "mounting post" 60. The post is milled out to form an internal slot 57 generally extending midway at least in part across the cap plate, the slot for receiving two threaded fasteners. The slot is bounded by a post wall that extends down from the underside of the cap plate, the post wall not exceeding the height of the external flange of the plastic sliderblock when mounted on the board. The mounting post inserts through the cutout in the sliderblock and the disk seats in a channel on the top face of the sliderblock so as to stiffen the assembly. Mating detents in the underside of the cap plate and on the top surface of the sliderblock prevent slip and allow the sliderblock to be adjusted crosswise on the post.

Advantageously, in a preferred embodiment, the underside of the cap plate is provided with a generally circular detent ring or tooth that engages one of a plurality of mating circular female grooves (88*a*,88*b*) in the top face of the sliderblock (detent ring 63*a*,63*b* and patterned surface 64,74), permitting a range of crosswise positional adjustment by reseating the cap plate along the sliderblock in incremental steps, each step corresponding to one of the circular female grooves of the pattern. The detent ring of the flanged disk may be positioned in any of the corresponding female grooves of the sliderblock, allowing the rider to center the binding crosswise on the board, toe and heel essentially equidistant from the edges of the board. This is an advance in the art in that a rider can position both sliderblocks (relative to their board fasteners) so as to be evenly centered ("toe-to-heel") and balanced, while not surrendering the capacity to independently angle the stance of each foot. Riders not so centered must compensate by muscling the board from turn to turn, at the very least a distraction from enjoying the ride, and may lose control. This adjustment system is also used to close the separation distance, end to end, between the pucks, as is needed to ensure that there is no looseness or strain in the fit of the boot binding baseplate when the toe locking member is inserted or snapped into place.

The mounting post of the "flanged disk" (51*a*,51*b*) seats in a butterfly cutout (55*a*,55*b*) in each sliderblock to provide reinforcement and secure the flange disk. The flanged disk is fitted with a flat "cap plate" 61 that extends, at least in part, across the top face of the sliderblock and an underside "mounting post" 60. The mounting post is formed with an internal slot 57 generally extending midway in part across the cap plate, the internal slot for receiving two threaded fasteners. The slot is bounded by a post wall that extends down from the underside of the cap plate, the post wall not exceeding the height of the external flange of the plastic sliderblock when mounted on the board. The mounting post inserts through the cutout in the sliderblock and the disk seats in a channel on the top face of the sliderblock so as to stiffen the assembly. Mating detents in the underside of the cap plate and on the top surface of the sliderblock prevent slip and allow the sliderblock to be adjusted crosswise on the post.

Advantageously, in a preferred embodiment, the underside of the cap plate is provided with a circular detent ring or tooth that engages one of a plurality of mating circular female grooves (88*a*,88*b*) in the top face of the sliderblock (detent ring 63*a*,63*b* and patterned surface 64,74), permitting a range of crosswise positional adjustment by reseating the cap plate along the sliderblock in incremental steps, each step corresponding to one of the circular female grooves of the pattern. The detent ring of the flanged disk may be positioned in any of the corresponding female grooves of the sliderblock, allowing the rider to center the binding crosswise on the board, toe and heel essentially equidistant from the edges of the board and adjust the stance angulation separately.

Straps and accessories are not shown for clarity. When both of the rider's boot bindings have been installed in this way, the completed assembly is termed the "ride mode interface" and the half board ski members (3,4) of a splitboard are rigidly joined at centerline junction 5. Advantageously, note that the baseplate also includes superimposed cutouts (103*a*, 103*b*) have a generally butterfly shape so that adjustments to the sliderblock position may be made while the boot binding baseplate is engaged, as aids in assuring that flange flats 54 are accurately installed in parallel. Boot binding baseplate 102 slideably inserts over the pucks and engages flange ledges 54 at mated flanges in an underside channel (33, referencing FIG. 3) as described earlier.

FIG. 14A is a plan view of a splitboard showing a single boot binding baseplate and puck assembly representative of a ride mode configuration. FIG. 14B is a detail plan view showing a section B-B cut plane. The view shows a boot binding baseplate slidingly engaged on the slider track of a fully assembled puck system including a pair of puck assemblies. One such assembly is provided for each boot of a rider. The boot bindings may be removed from the ride mode interface and installed in alternation on a ski tour mode interface, which includes a toe pivot cradle for free heel skiing or trekking.

FIG. 14C is a section view taken at section B-B of FIG. 14B. Shown are boot binding baseplate 102 engaged on a puck assembly with locking flanged disk 51*a* and threaded fastener 56*a*. Also shown is an inside flange edge 105 of an underside channel in the baseplate for engaging outside flange 54 of the sliderblock 52. The exterior flange of the sliderblock 54 is seen to grippingly interlock an internal bottom flange 105 of the boot binding. A thinner flange is formed by extension of the cap plate of the flanged disk 51*a* and braces the exterior flanges of the sliderblock. Slot 57 is cut at an angle in this B-B section.

FIG. 15 is a schematic demonstrating the three-fold range of adjustments enabled using the puck system of the invention. Realized are combinations of three degrees of freedom as needed for a completely adjustable ride mode interface. With the puck system, boot placement, boot angle, and crosswise centering on the board may be adjusted according to the rider's preference. Each puck system consists of pairs of sliderblocks (52,53) and flanged disks (51*a*,51*b*), each with a pair of fasteners mounted in a single center slot 57 for each boot. A dashed centerline 5 is shown for reference, along with rows of tapped mounting holes 91 on either side a board centerline. Adjustability includes rotation of the sliderblocks (52,53) on the flanged disks (51*a*,51*b*), "toe-to-heel" centering (crosswise relative to centerline 5), and long axis positioning (using slot 57 adjustment in combination with selection of mounting holes 91 independently for each foot). As currently practiced, adjustment increments are 0.167 inches crosswise, 0.05 inches longwise, and rotationally in 2.6 degree increments. As currently practiced, total adjustment range is 0.5 inch crosswise, up to 6.1 inch longwise and 60 degrees rotationally for each foot. Longwise adjustment is in part dependent on the manufacturer's "insert" pattern. Typically up to six inserts are supplied at intervals of about 1". The length of any slot for "T-nuts" on a channel board may also be varied according to the manufacturer's preference, but is generally sufficient to accommodate a range of stances.

The centerline is shown as a dashed line because the pucks may be mounted not only on splitboards but also on a variety of gliding boards including solid boards, also known as "snowboards". Puck systems of the invention incorporate a novel toe-to-heel centering system that may be used with other boot binding interfaces of the art. Boot bindings anticipated to benefit from this new level of adjustability include systems made for conventional Voilé (Salt Lake City, Utah) pucks, and also systems having other interface designs such as those shown in U.S. Pat. No. 8,764,043 to Neubauer of Karakoram (North Bend, Wash.), the Ignition, Fuse, Burner, Afterburner, Magneto, Blaze, and other systems of Spark R&D (Bozeman, Mont.), aspects of which are shown in U.S. Pat. Nos. 7,823,905, 8,226,109, 9,022,412, and 9,126,099), the systems of Phantom (US Pat. Doc. No. 2014/0232087 to Keffler), Plum (Cedex, FR), Watson (US Pat. Doc. No. 2013/0200594), Balin (U.S. Pat. No. 8,708,371), and related systems, including more generally those of snowboard and "solid board" mounting systems in need of "toe-to-heel" positioning of a boot binding interface.

Figure 17:
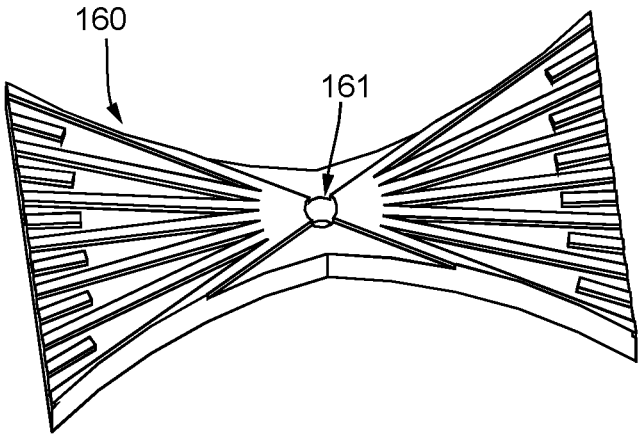
FIG. 17 depicts an early model of a "mini" spacer accessory to be used as a fitting tool for puck alignment by a method of the invention.

The puck systems and puck alignment tools described below are compatible with splitboards using the industry-standard Voilé hole pattern. The vast majority of commercially available splitboards use this standard. As currently practiced, the newly developed mini-puck alignment tools of FIG. 17 and FIG. 18 are compatible with Arc, Magneto, Tesla and Burton Hitchhiker splitboard bindings.

Advantages of using the puck system of the invention include controlled torsional stiffness of the bootbinding baseplate, as useful for improved foot roll. During foot roll, the rider can store spring energy in the elastic superiolateral flanges of a plastic sliderblock. This energy is returned to the rider exiting a maneuver and propels the rider back up to an upright position. Thus the puck system of the invention is improved over both the rigid systems known in the art and the more compliant and wobbly interface systems in use.

FIGS. 16A, 16B, 16C and 16D are components of an exemplary kit realizing a first embodiment of the puck systems of the invention. The kit typically includes two toeside sliderblocks 52, two heelside sliderblocks 53, four flanged disks 51 (shown here with a scalloped center slot 57) eight fasteners 56, and an installation alignment tool or tools as will be described below. The toeside sliderblock 52 is dimensioned to be longer than the heel block 53 so that adjustment begins from a toeside bias necessitated for the toe pivot nose of the baseplate.

Also provided are puck installation alignment tools. Using a tool, a user may set an initial position for each sliderblock, and then after a test run, make fine adjustments or a series of adjustments until a preferred position is achieved. FIG. 17 depicts an early model of an accessory to be used as a pocket-sized fitting tool 160 for puck alignment by an alignment method of the invention. The molded part is designed as a spacer between a toeside puck and a heelside puck during setup. The ribs assist in angular adjustment relative to a centerline on a board. The center hole 161 lines up with the centerline of a splitboard, ensuring proper toe-to-heel centering.

Figure 18A:
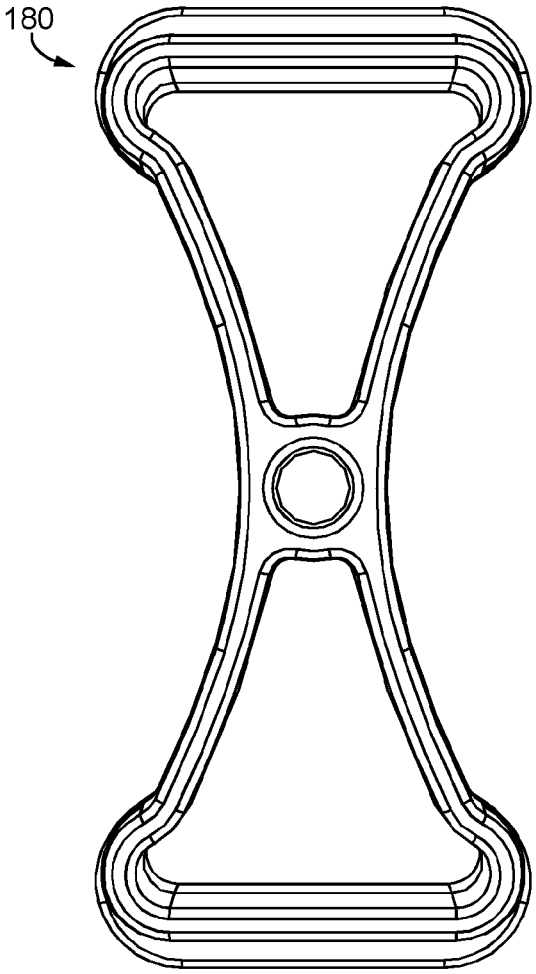
FIGS. 18A, 18B and 18C are views of an exemplary fitting tool for puck alignment when used with a puck system of the invention.
Figure 18B:
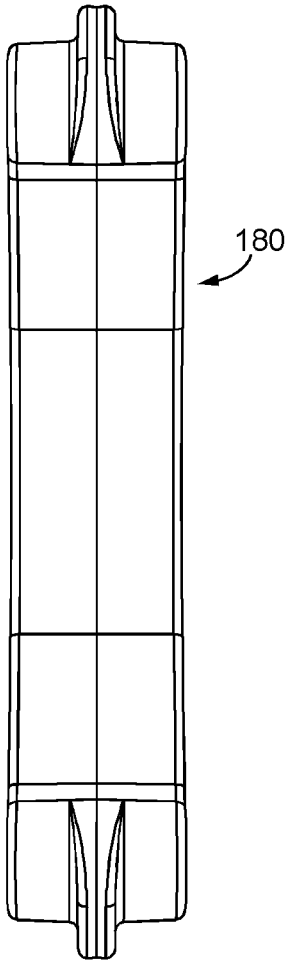
Figure 18C:
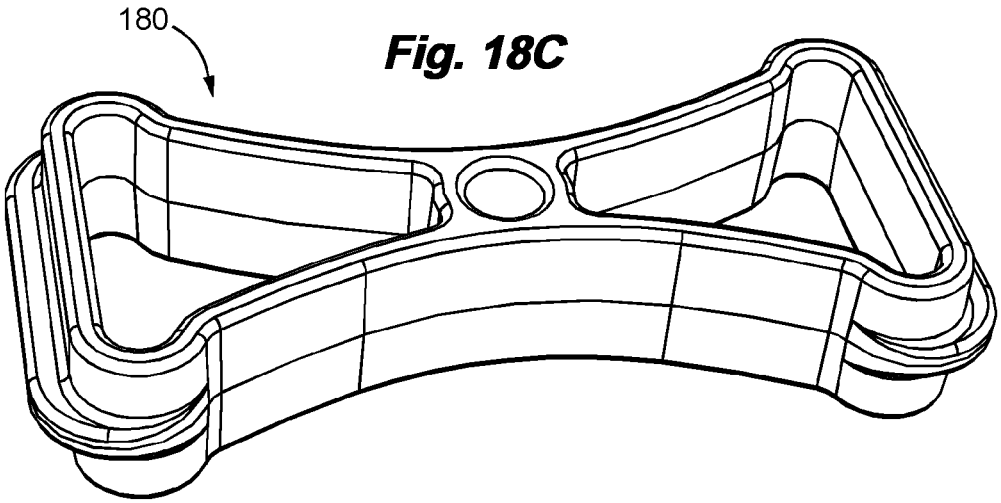

FIGS. 18A, 18B and 18C are views of a second exemplary fitting tool 180 for puck alignment when used with a puck system of the invention. The tool is designed as a spacer to orient and spread apart the two slider blocks of a puck system at a prescribed distance end-to-end.

Figure 19A:
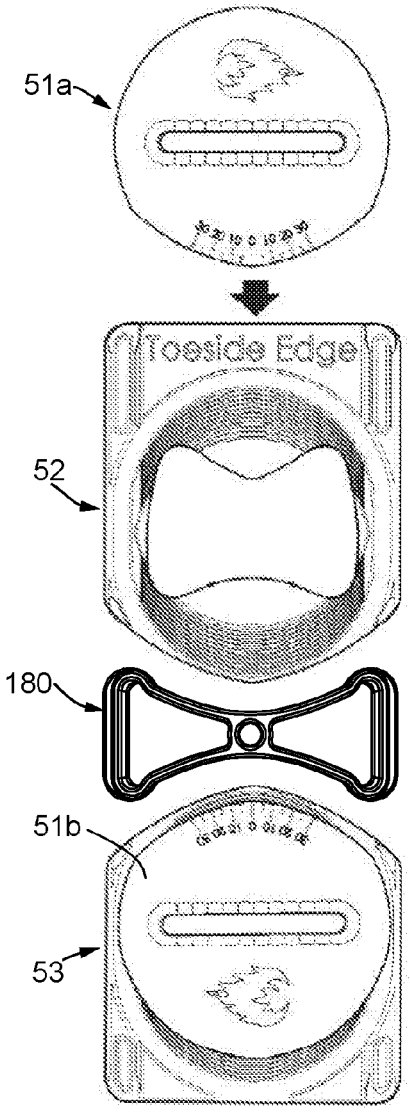
FIGS. 19A, 19B, 19C and 19D are views of steps of a first exemplary method of puck alignment when used with a puck system of the invention.
Figure 19B:
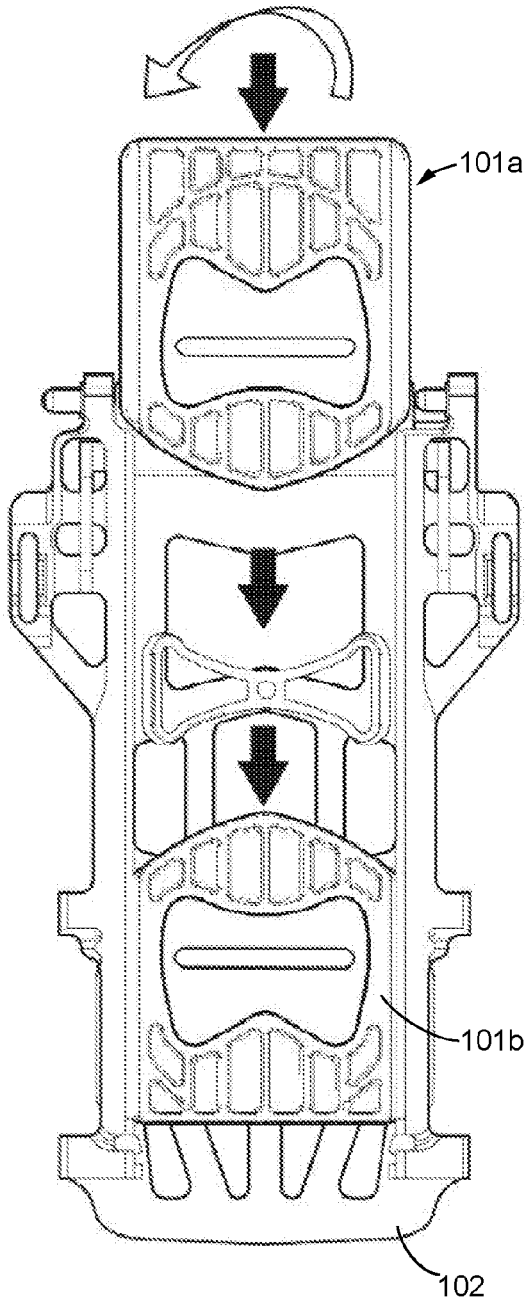
Figure 19C:
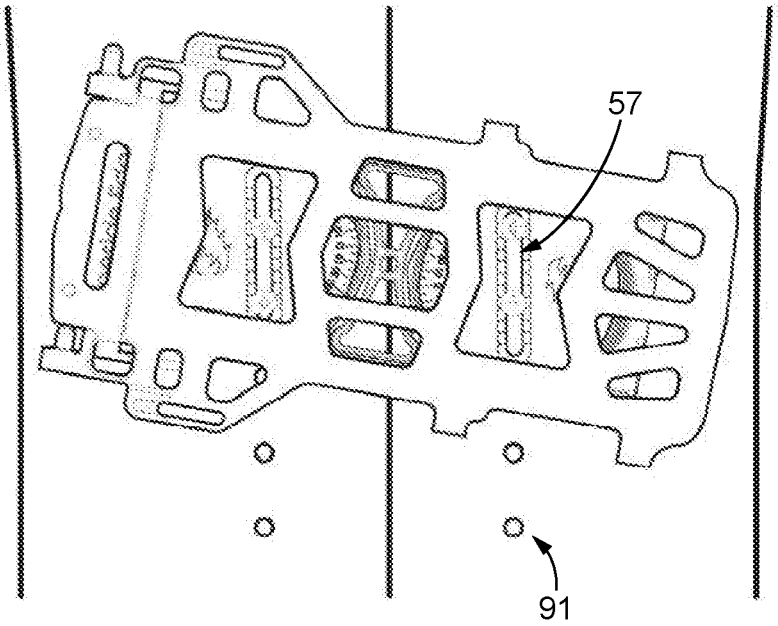
Figure 19D:
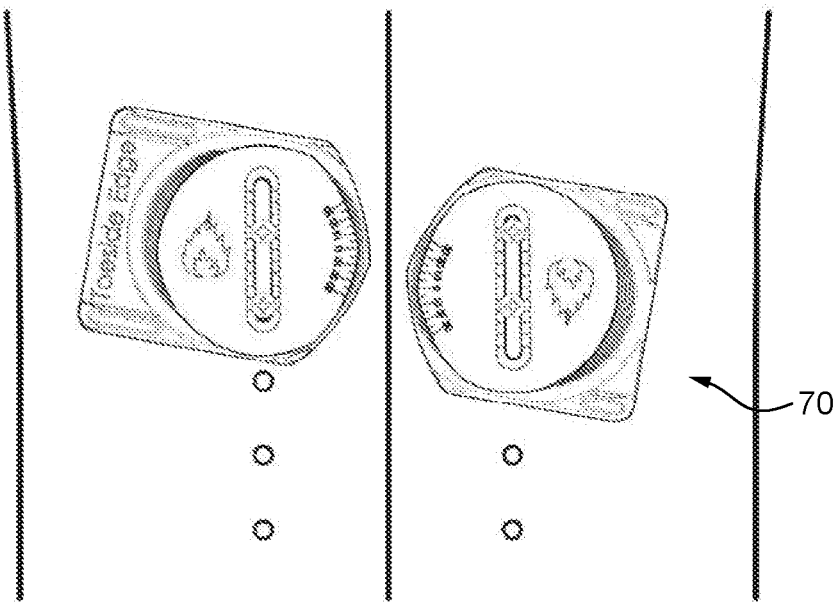

FIGS. 19A, 19B, 19C and 19D are views of steps of a first exemplary method of puck alignment when used with a puck system of the invention and a pocket tool 180. Setup begins by determining a comfortable stance including angle and position where the puck system is to be placed. The board is fully assembled for this step so that the rider can stand on the board and mark foot placement. In preparation for installation, insert a flanged disk into each of the sliderblocks with angle indicators pointing centerwise. Correct orientation is indicated in FIG. 19A. Then turn a bootbinding baseplate 102 upside down as shown in FIG. 19B and slide the heelside puck assembly 101*b*, heelside first into the underside channel, followed by pocket alignment tool 180, and then toeside puck assembly 101*a* with toeside out at the toe end. Flip the baseplate over on the board. Close the toe ramp of the binding to snug up the three pieces. Position the binding per foot placement marks made earlier and rough in alignment by rotating the flanged disks (accessible through a cutout in the binding) until a pair of tapped inserts 91 are visible through the slots 57 of each puck assembly. Drop the supplied fasteners into the inserts or "T-nuts" and loosely tighten with a screwdriver or compatible bit driver. Rotate the pucks to the desired stance angle. Once the puck system is positioned and centered, tighten the screws (FIG. 19C). Remove the baseplate, pull out the alignment tool, and then slide the baseplate back onto the now complete ride mode interface 70 for one foot (FIG. 19D). Secure it at the toe end with a toe pin or toe ramp. If necessary, loosen and nudge the toeside puck in or out and retighten the screws until a secure fit is obtained. Strap the boots on and recheck the heel-to-toe centering. If necessary, re-insert the alignment tool, loosen the screws, and slide the pucks cross-wise to get a good centering of the boots between toe or heel board edges. Remove the tool, tighten all screws and check the centering again. When satisfied, repeat for the other foot. This completes a stance adjustment with crosswise toe-to-heel centering using a pocket alignment tool. The boot binding 102 illustrated here has an exemplary toe pivot mechanism distinct from that shown in FIG. 3.

Figure 20A:
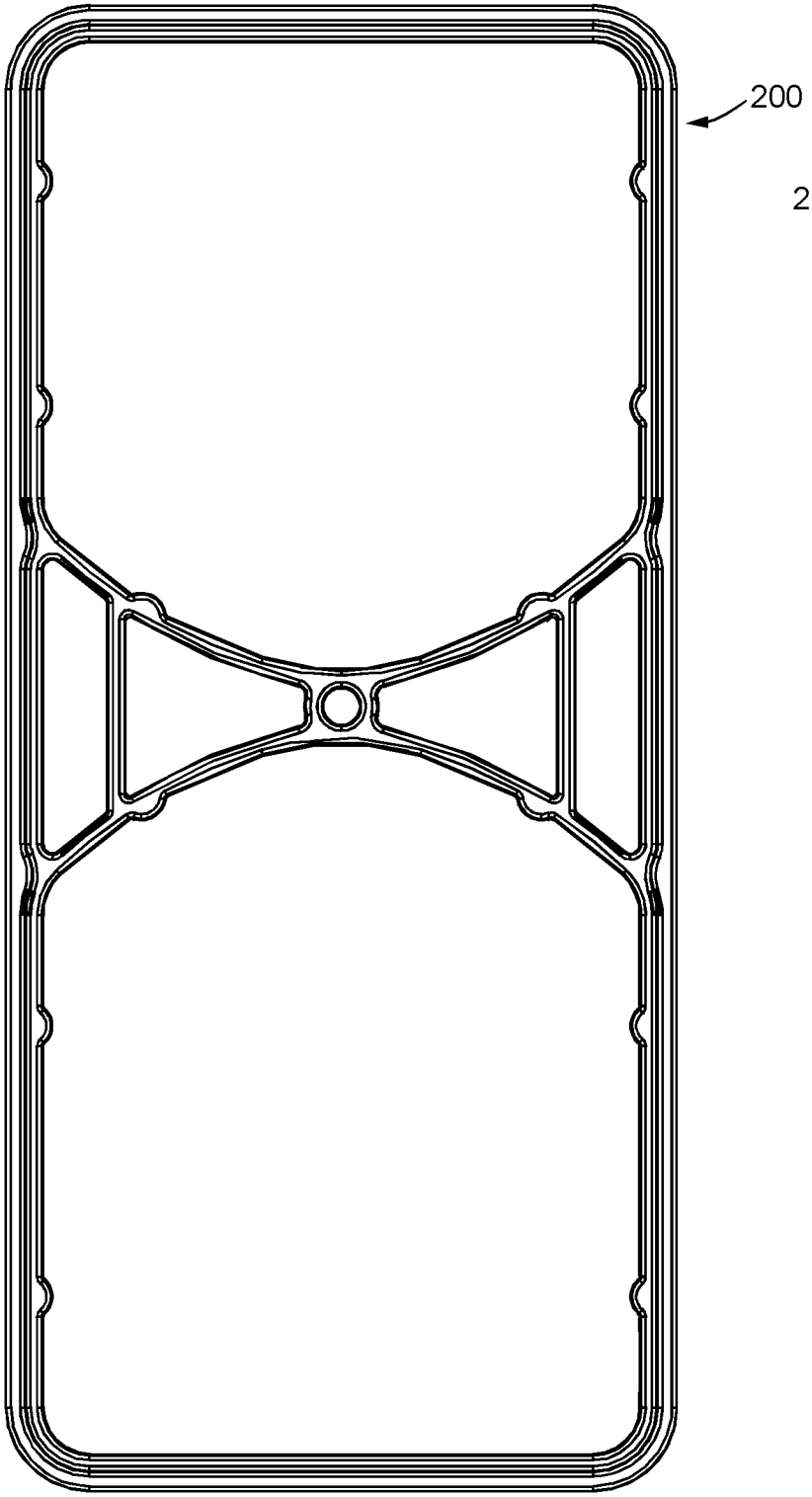
FIGS. 20A, 20B and 20C are views of a second exemplary fitting tool for puck alignment.
Figure 20B:
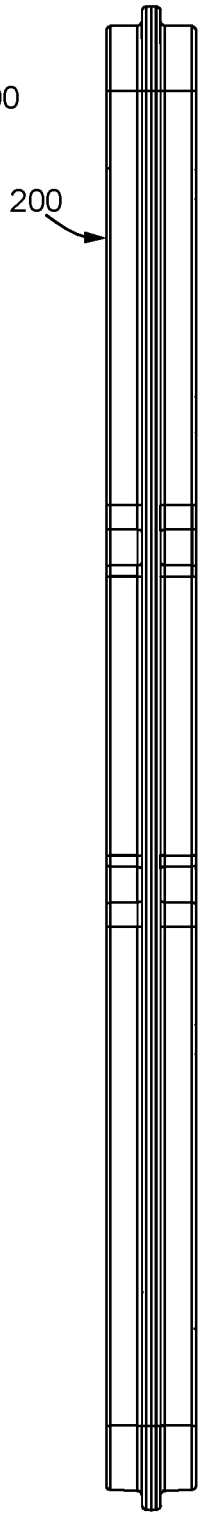
Figure 20C:
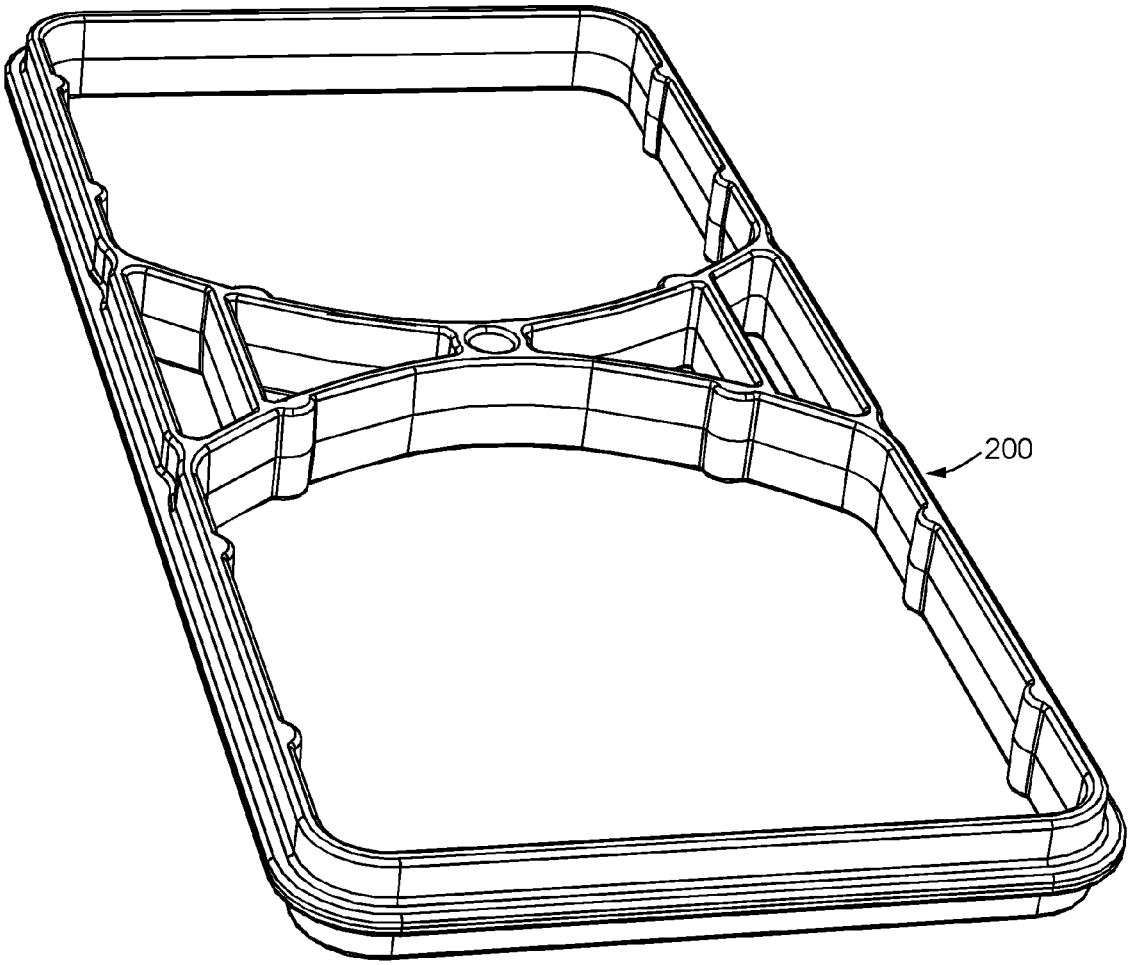

FIGS. 20A, 20B and 20C are views of another exemplary fitting tool 200 for puck alignment. This is termed a "full frame" adjustment tool or "jig" to differentiate it from the pocket adjustment tool of the preceding figures and includes an outside frame for parallelizing the puck outside flanges during installation. The full frame adjustment tool provides a rigid girth around the sliderblocks and ensures tighter control of the puck assemblies during positioning so that the lateral edges are precisely parallel without the encumbrance of using a baseplate 102 as a guide.

Figure 21A:
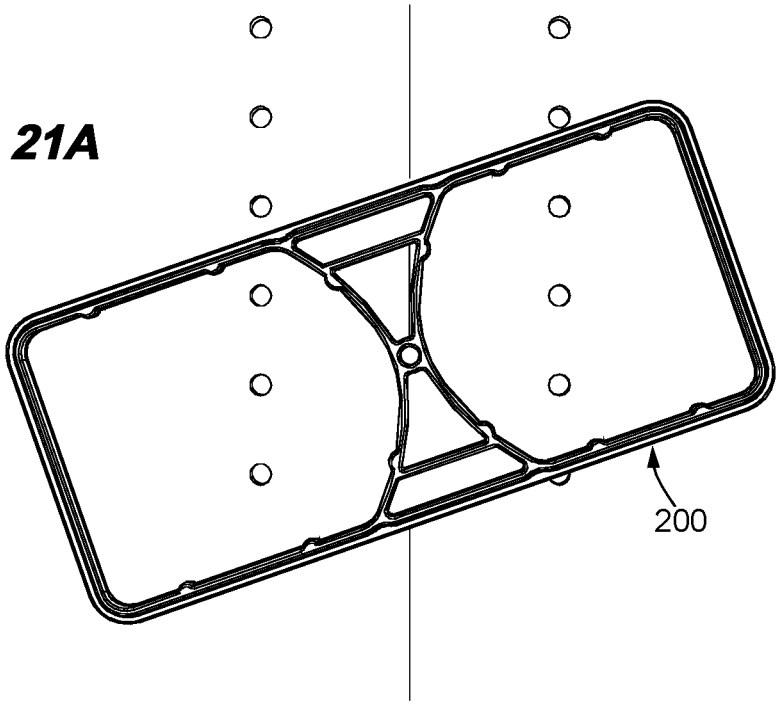
FIGS. 21A, 21B, 21C, 21D, 21E and 21F are views of steps of a second exemplary method of puck alignment when used with a puck system of the invention.
Figure 21B:
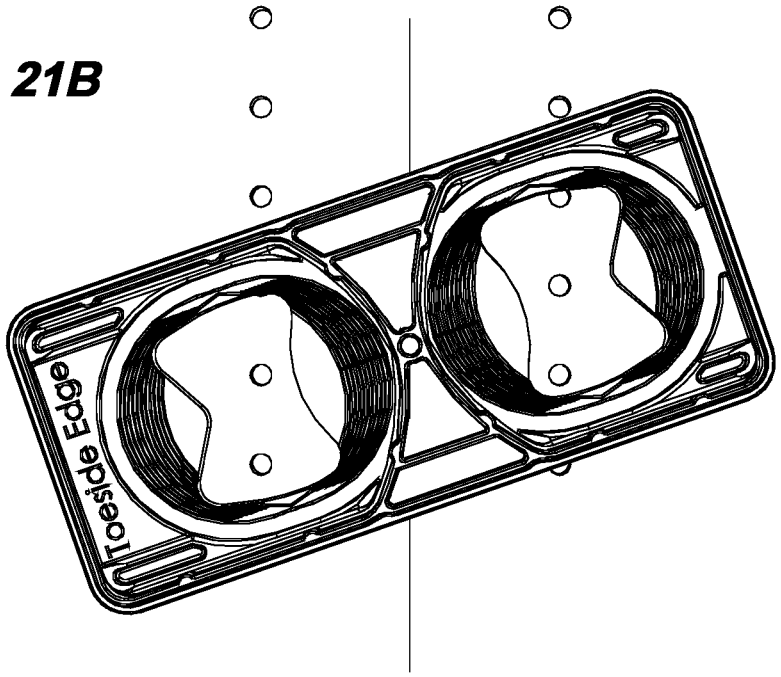
Figure 21C:
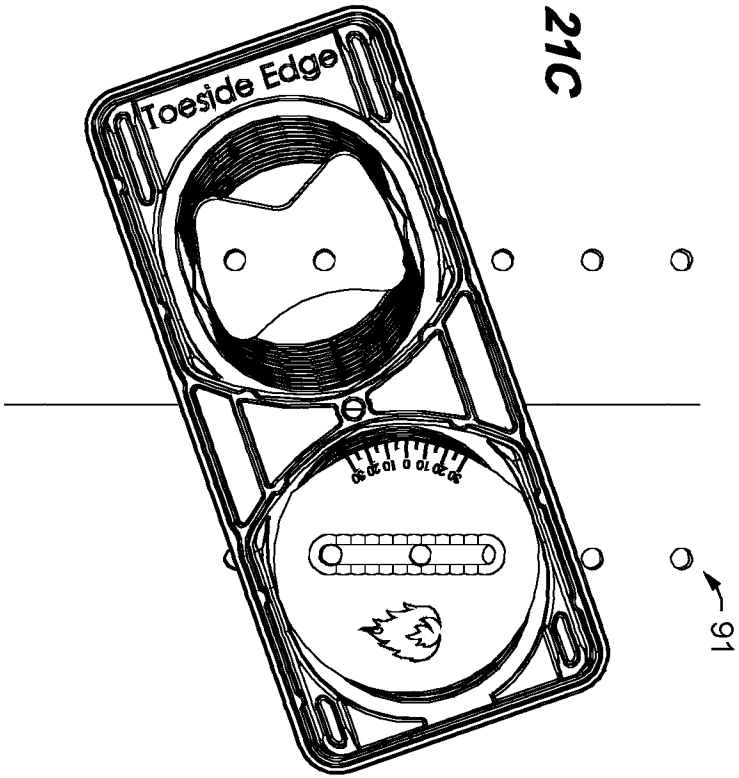
Figure 21D:
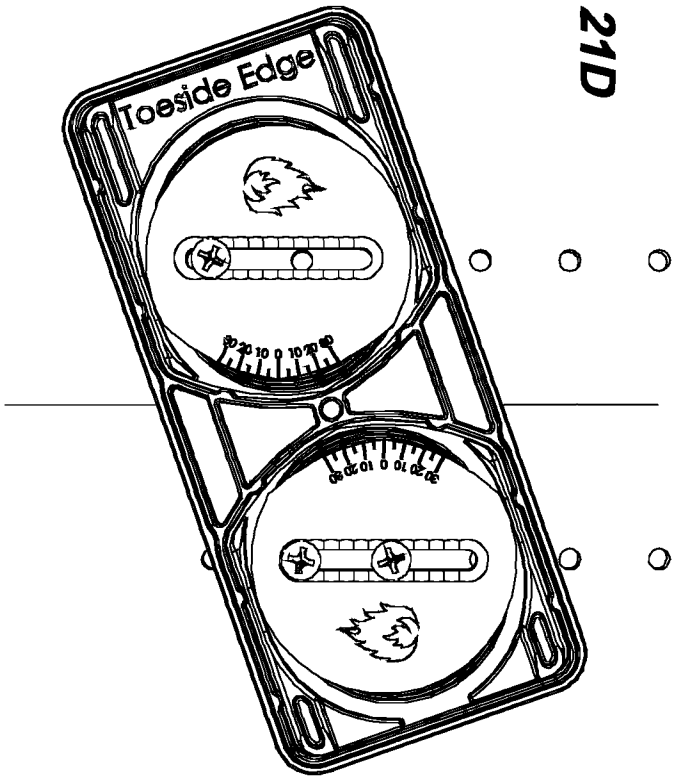
Figure 21E:
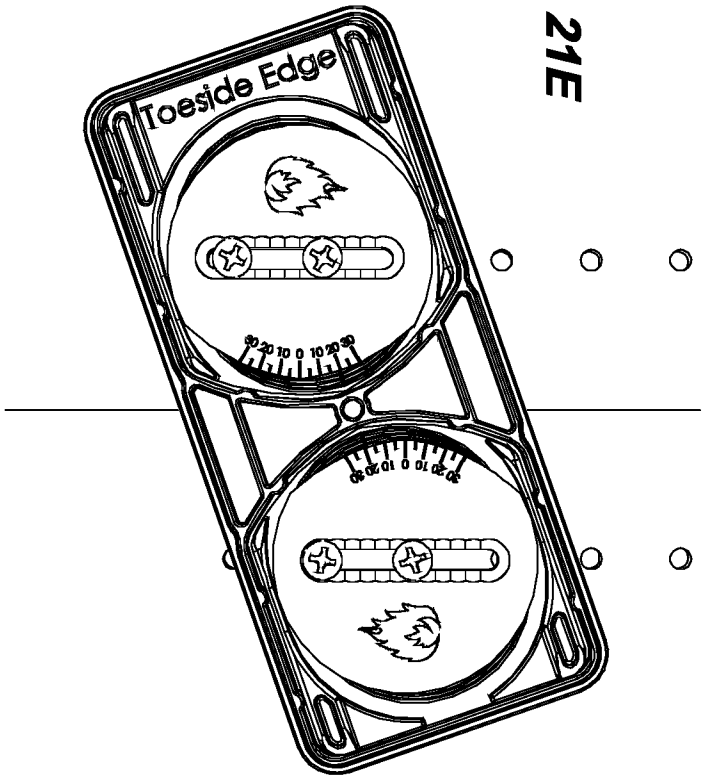
Figure 21F:
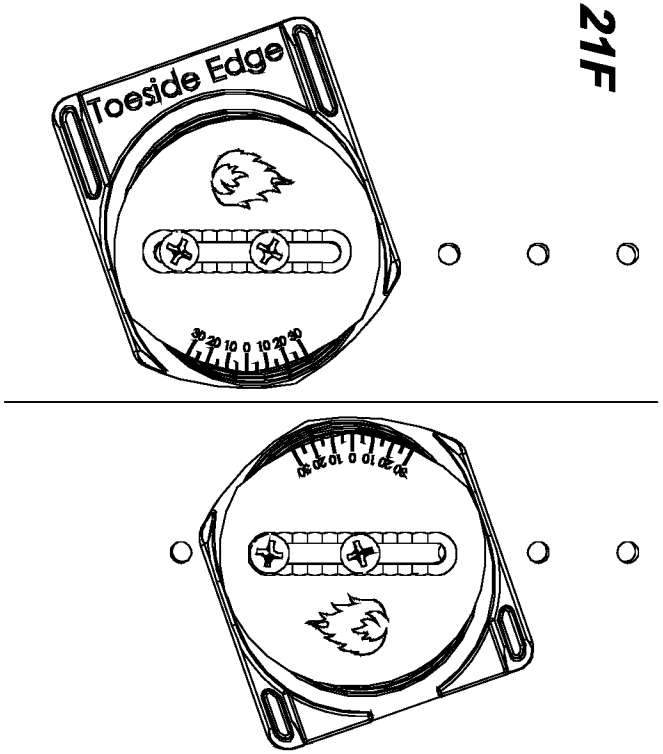

FIGS. 21A through 21F are views of steps of a second exemplary method of puck alignment when used with a puck system of the invention. Setup again begins by determining a comfortable stance and the angle and position where the puck system is to be placed. Usually this is done by standing on the board and marking each foot. When ready, as shown in FIG. 21A, place the full alignment framing tool on the board (if a splitboard, first fasten together the ski halves). Locate the tool over the desired position of one of your feet and rough in the rotational angle. Insert a toeside puck (marked with "toeside edge") and a heelside puck into the frame as shown in FIG. 21B. The frame can be positioned on the centerline of the board by sighting it in the center punch out of the frame. Drop an aluminum center disk into the mounting channel of each of the pucks as shown in FIGS. 21C and 21D, initially without inserting the threaded fasteners. Select a preferred angulation and line up the slot in the flanged disk with two tapped holes 91 on the board surface. Rotational degree indicia should point toward the center line of the board. Rotate the alignment tool (and rotate the flanged disks) so that you can see the inserts 91 through the slot in the disk. The framing tool will ensure that the sliderblocks are parallel and properly spaced. Insert two screws through each disk into the inserts in the board (referencing FIG. 21D). Tighten a few turns with a screwdriver and then rotate pucks to desired angle. The pucks can also be slid on the fasteners if sufficiently loose. A complete ride mode interface assembly, with tool, is shown in FIG. 21E. Tighten the screws to lock the pucks in place. Remove the alignment tool (FIG. 21F) and check alignment by sliding a bootbinding baseplate onto the pucks and secure it with a toe pin or latch. If unable to secure the bindings at the toe, or the fit is too loose, loosen the screws, nudge the toeside puck, and retighten the screws. Repeat this process until the baseplate is secure and centered.

Additional adjustment may be required if the boots are biased toewise or heelwise. To adjust centering, replace the alignment tool, loosen the screws, and slide pucks toward toe or heel edge. Then recheck with boots on. When satisfied, repeat for the other foot and tighten everything down. This completes a stance adjustment with cross-wise toe-to-heel centering using a full frame installation alignment tool.

More generally the installation and alignment method of the invention includes at least steps for a) providing to a rider a toeside puck and a heelside puck for each boot, each the puck having a flanged disk mounted in a channel on top of the sliderblock, where a bottom surface of each flanged disk and a top surface of each channel are configured with a plurality of interlocking engagement detents; b) affixing the sliderblocks in pairs to a board surface by seating the flanged disks on top of the sliderblocks and fastening the flanged disks loosely to the board surface with two threaded fasteners; c) cooperatively adjusting the sliderblocks pairwise on the flanged disks so as to center the first boot binding crosswise toe-to-heel relative to a centerline of a board while ensuring that the sliderblock outside edges are parallel; and, d) tightening the threaded fasteners to secure the sliderblocks in a centered position. Added steps may include a step for adjusting the sliderblocks on the flanged disks so as to define an end-to-end distance for securing a heel lock of a bootbinding baseplate in locking contact with an outside end of the heel puck and a toe lock of the baseplate contact with a toe end of the toe puck as needed to ensure the boot binding baseplate is securely mounted on the pair. Longwise adjustment and rotational adjustment are also accommodated during setup and installation, but the invention is distinguished by the capacity to perform an installation alignment having three degrees of freedom, longwise stance placement (ie., positioned a generally sideways stance on the board with legs spread), rotational stance angle (positive or negative angle as preferred by the rider), and crosswise stance centering relative to the centerline of the board (as needed for better balance and control, as has been lacking or inadequate in the prior art). Also anticipated is a step or steps for using an alignment jig during installation for cooperatively aligning and orienting the puck pairs and for cooperatively spacing the toeside puck and the heelside puck. Snug locking of the baseplate onto the parallel outside flanges of the puck pairs is needed for solid control of the ride. All these features and more are easily accomplished using the puck systems of the invention according to the methods described above.

Figure 22:
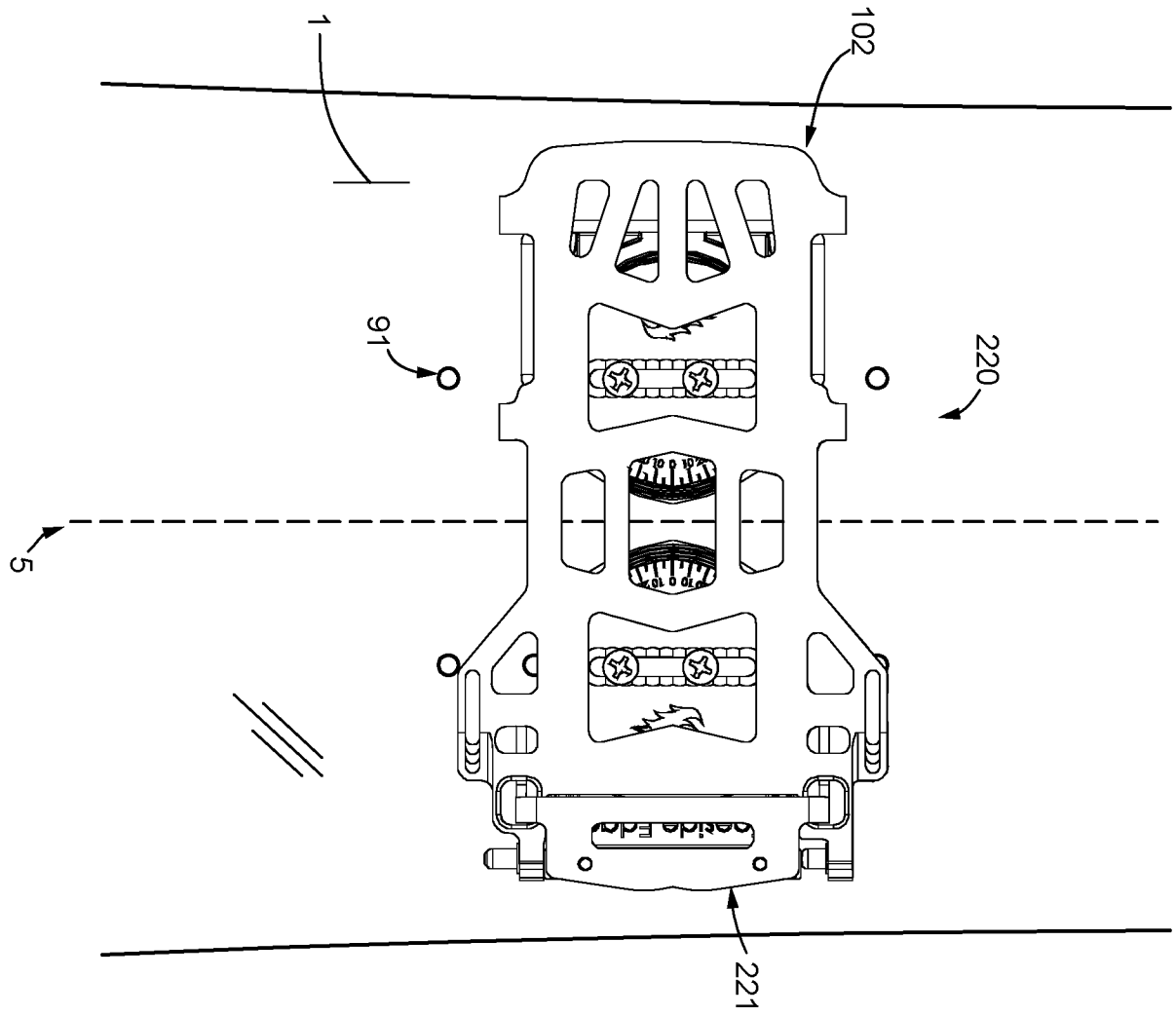
FIG. 22 is a rendering of an installed ride mode interface with a puck system; a boot binding baseplate is shown, secured on the pucks.

FIG. 22 is a CAD rendering of a "ride mode" or "descent" interface with for one foot, showing a puck system of the invention fully installed and adjusted to illustrate crosswise centering. The puck system corrects the problem described in FIG. 1, the toe overhang 2*a*, and also corrects any heel overhang or imbalance caused by an off-center binding interface. Boot binding baseplate 102 is shown, secured on the slider track of fully assembled paired puck assemblies of the invention, in a neutral position, with no angulation. The baseboard is centered toe-to-heel relative to the lateral edges of the board. In this exemplary puck system and baseplate combination 220, a toe pivot pin is not used; instead a toe latch plate or "ramp" 220 is used, but the effect is the same, to lock the puck assemblies in an underside channel of the boot binding baseplate. With the new flexibility in centering adjustment, the conventional 7⅝ inch end-to-end fixed separation of the sliderblocks is no longer strictly required, allowing manufacturers to make more petite boot binding baseplates. The longer toeside edge sliderblock, in part visible here, ensures that heelside bias is eliminated; boot bindings can be positioned with the rider centered on the board in spite of the extra length of the baseplate needed for the toe latch mechanism. Other components of a boot binding are not shown for clarity in illustrating the puck system attachment.

The puck system may also be used with a snowboard, as indicated here by the dashed arrow at the centerline. However, additional tapped holes 91 may have to be drilled and nuts inserted if the standard four hole pattern supplied with snowboards is not compatible with the slot size of the pucks. Most ski shops are able to retrofit the needed mounting hardware. Manufacturers, recognizing the demand for boards that are compatible with the puck system of the invention and the advantages of correct torsional stiffness K, are anticipated to supply these holes as an OEM feature.

As disclosed here, the invention realizes an improved ride mode interface for splitboarding (or crossover snowboarding), which comprises for each foot: a) a first puck and a second puck enabled to be fastened on a top surface of a board, each the puck having: i) a flanged disk with cap plate and underside surface, the flanged disk having a mounting post on the underside surface, the mounting post having walls defining a slot extending therethrough, the slot for receiving a pair of threaded fasteners; ii) a sliderblock with topside face, underside face, and two superiolateral parallel flange edges contralaterally disposed thereon, a recessed mounting channel between the flanges, the channel having a width and depth adapted to receive the flanged disk, and a cutout extending through the sliderblock in the mounting channel, such that the cutout is enabled to receive the mounting post; b) wherein the first puck and the second may be cooperatively rotated so that the contralateral parallel flanges are aligned for receiving a boot binding; and, c) further characterized in that the topside face of the sliderblock in the mounting channel comprises a plurality of offset circular grooves and the underside surface of the flanged disk comprises at least one detent ridge ring adapted to lockingly engage one of the plurality of offset circular grooves when tightened against the sliderblock member, the offset circular grooves enabling incremental adjustment of the separation distance between the first puck and the second puck, while independently enabling both (i) centerwise adjustment of the position of the pucks crosswise on a board and (ii) cooperative rotational angulation of the pucks as needed to achieve parallel flange alignment for receiving the boot binding baseplate. The ride mode interface is compatible with and may be used in combination with a boot binding baseplate having an underside channel with internally disposed inferiolateral flanges (configured to mate with the outside flanges edges of the sliderblocks) and a toe latch. When used for splitboarding, the toe latch is configured as a toe pivot for use in ski tour mode.

Puck systems of the invention may be provided as kits to accompany sales of boot bindings, boards, or combinations of boot bindings and boards as complete sets. Representative claims to kits for mounting a pair of boot bindings on a snow gliding board include components needed to mount each boot binding of a pair of boot bindings, and include: a) a pair of puck assemblies for cooperatively mounting each boot binding, where each puck assembly of the pair comprises a sliderblock, a flanged disk, and a pair of fasteners, the sliderblocks having contralateral flange ledges, and further in which the pair of puck assemblies are configured for pairwise adjustment of stance orientation for each boot binding in three degrees of freedom. The three degrees of freedom include: a) pairwise boot placement adjustment relative to the nose end and tail end of the board, b) pairwise boot angulation optimal for the rider, and, c) pairwise crosswise centering for each boot relative to the edges of the board.

Also included in kits of the invention are an optional installation alignment tool configured to cooperatively orient the puck assemblies so that the flange ledges of the pair of puck assemblies are parallel as installed. Generally the installation alignment tool is further configured cooperatively position the puck assemblies so that the sliderblocks are installed with any prescribed separation distance. In preferred embodiments, the installation tool comprises a first tool having a frame sized to engirdle the puck assemblies during installation and instructions for its use. In another preferred embodiment, the kit includes a pocket-sized installation and alignment tool, and instructions for use. Thus both shop installations and field adjustments are readily accomplished with a high level of accuracy and satisfaction.

These kits may be sold to accompany sales of pairs of boot bindings, each boot binding having a baseplate with underside channel having the matching flanges for conjoinedly gripping and interlocking the pucks. Similarly, board sales may be accompanied by sales of kits of the puck systems of the invention; generally these are sold with compatible boot bindings.

Kits may also be sold to existing owners of certain boards and binding systems compatible with the use of puck assemblies such as those of Voilé and Spark R&D. A large number of existing board owners may benefit from the improved puck systems, and kit contents are preferably configured to meet their needs in upgrading OEM systems already in use. Advantageously, these riders also benefit from the improved performance of the pucks, which defines a ride mode interface (when testing in combination with a compatible boot binding baseplate) achieving a torsional stiffness in the range of 70 to 130 inch-lb/degree when the baseplate is mounted on the puck assemblies—as is optimal for effective foot roll and other ride maneuvers. Thus it is expected that a significant number of riders will chose to upgrade their gear, and will require a kit having all the needed parts, including perhaps a tool such as a Phillips Head screwdriver or an Allen wrench for driving home the fasteners. Over time, OEM manufacturers may adjust their positioning of inserts and channel nuts so that a greater range of boards are compatible with the new ride mode interface improvements. Four hole mounting patterns may be supplemented with rows of inserts so that riders can interchange their binding gear between splitboards and snowboards for example, allowing a rider to simply uncouple from one ride interface and slide into another ride interface in order to go from snowboarding the lifts in the morning and splitboarding the backcountry in the afternoon, for example, an advance in the art.

EXAMPLE I

In a first embodiment, design a puck system having a first pair of puck assemblies for a first boot of a rider and a second pair of puck assemblies for a second boot of a rider, each the puck assemblies of the pair including (a) a sliderblock having contralaterally disposed superiolateral edge flanges, wherein the edge flanges define a slider track configured to receive an underside channel of a boot binding thereon; (b) a flanged disk configured to seat on top of the sliderblock between the edge flanges; (c) a pair of fasteners affixable to mounting hardware disposed in a top surface of a splitboard; wherein the fasteners are adapted to capture the sliderblock under the flanged disk and compressedly lock the sliderblock between the flanged disk and a top surface of a splitboard on which the sliderblock rests. Advantageously, (i) the flanged disks are configured to be slideably adjusted pairwise on the at least one fastener longwise on a centerline of the splitboard, thereby defining a first degree of freedom for adjustment of stance; (ii) the sliderblocks are configured to be adjustably rotated pairwise on the flanged disk relative to a centerline of the splitboard, thereby defining a second degree of freedom for adjustment of stance; and, (iii) the sliderblocks are configured to be slideably adjusted pairwise on the flanged disks, having a crosswise slideable adjustment relative to a centerline of the splitboard, whereby a boot binding is adjustable toe-to-heel to be equidistant from the lateral edges of a splitboard, thereby defining a third degree of freedom for adjustment of stance.

EXAMPLE II

In an alternate embodiment, design a puck system with crosswise adjustment for snowboards having an industry-standard four hole pattern. A sliderblock is configured as a rail which may slide crosswise under or over a pair of mounting disks with posts, such that each post is affixed to the snowboard. Longwise adjustment is also contemplated. In yet another example, the two mounting disks may be combined as a single element slideably supporting the sliderblock, and optionally the sliderblock may be configured with a slider track.

INCORPORATION BY REFERENCE

All of the U.S. patents, U.S. patent application publications, U.S. patent applications, foreign patents, foreign patent applications and non-patent publications referred to in this specification and related filings are incorporated herein by reference in their entirety for all purposes.

SCOPE OF THE CLAIMS

The disclosure set forth herein of certain exemplary embodiments, including all text, drawings, annotations, and graphs, is sufficient to enable one of ordinary skill in the art to practice the invention. Various alternatives, modifications and equivalents are possible, as will readily occur to those skilled in the art in practice of the invention. The inventions, examples, and embodiments described herein are not limited to particularly exemplified materials, methods, and/or structures and various changes may be made in the size, shape, type, number and arrangement of parts described herein. All embodiments, alternatives, modifications and equivalents may be combined to provide further embodiments of the present invention without departing from the true spirit and scope of the invention.

In general, in the following claims, the terms used in the written description should not be construed to limit the claims to specific embodiments described herein for illustration, but should be construed to include all possible embodiments, both specific and generic, along with the full scope of equivalents to which such claims are entitled. Accordingly, the claims are not limited in haec verba by the disclosure.

I claim:

1. A puck system for mounting a pair of boot bindings on a snow gliding board, which comprises a pair of puck assemblies for cooperatively mounting each boot binding, wherein each puck assembly of said pair comprises a sliderblock, a flanged disk, and at least one fastener, and further wherein said pair of puck assemblies are configured to cooperatively adjust stance orientation for each boot binding in three degrees of freedom including: a) pairwise boot placement adjustment relative to the nose end and tail end of the board, b) pairwise boot angulation optimal for the rider, and, c) pairwise crosswise centering for each boot relative to the edges of the board.

2. The puck system of claim 1, wherein said puck system comprises a first pair of puck assemblies for a first boot of a rider and a second pair of puck assemblies for a second boot of a rider, each said puck assemblies of said pair comprising a a) sliderblock having contralaterally disposed superiolateral edge flanges, wherein said edge flanges define a slider track configured to receive an underside channel of a boot binding thereon;

b) a flanged disk configured to seat on top of said sliderblock between said edge flanges;

c) at least one fastener affixable to mounting hardware disposed in a top surface of a snow gliding board; wherein said at least one fastener is adapted to capture said sliderblock under said flanged disk and compressedly lock said sliderblock between said flanged disk and a top surface of a snow gliding board on which said sliderblock rests;

further wherein, i) said flanged disks are configured to be slideably adjusted pairwise on said at least one fastener longwise on a centerline of said snow gliding board, thereby defining a first degree of freedom for adjustment of stance;

ii) said sliderblocks are configured to be adjustably rotated pairwise on said flanged disk relative to a centerline of said snow gliding board, thereby defining a second degree of freedom for adjustment of stance; and, iii) said sliderblocks are configured to be slideably adjusted pairwise on said flanged disks, having a crosswise slideable adjustment relative to a centerline of said snow gliding board, whereby a boot binding is adjustable toe-to-heel to be equidistant from the lateral edges of a snow gliding board, thereby defining a third degree of freedom for adjustment of stance.

3. The puck system of claim 2, wherein a) said flanged disk comprises a cap plate with underside surface and flange edge, a mounting post centrally dependent from said underside surface, a detent feature peripherally disposed on said underside surface; and, b) said sliderblock comprises a top surface having a recessed mounting channel for receiving said cap plate with flange edge, a center cutout for receiving said mounting post, and a patterned surface on said top surface for engaging said detent feature of said flanged disk.

4. The puck system of claim 3, wherein said detent feature is a circular detent ridge and said patterned surface comprises a plurality of mating circular female grooves, each groove being offset stepwise along said mounting channel, each groove defining one of a plurality of axes of rotation of said sliderblock on said detent ridge, each said axes of rotation having a incremented stepwise offset from a centerline of a snow gliding board.

5. The puck system of claim 2, wherein said pairwise angulation of said sliderblock on said flanged disk is enabled over a range of 30 to −30 degrees relative to a stance normal to a centerline of a snow gliding board and said crosswise slideable adjustment of said sliderblock on said flanged disks is incrementally adjustable over a range of 0.5 inches or more.

6. The puck system of claim 2, wherein said sliderblock is a compressible plastic member having an internal cutout for receiving said mounting post.

7. The puck system of claim 2, wherein said mounting post of said flanged disk defines an internal slot, said slot for admitting said at least one fastener therethrough.

8. The puck system of claim 2, wherein said puck assembly comprises a metallic flanged disk and a reinforced plastic sliderblock.

9. The puck system of claim 2, wherein said pairs of puck assemblies are each configured to be separated by a fixed separation distance.

10. The puck system of claim 2, wherein said first puck pair includes a toeside sliderblock and a heelside sliderblock, and said toeside sliderblock has a larger aspect ratio than said heelside sliderblock.

11. The puck system of claim 2, wherein said at least one fastener comprises one pair of fasteners per puck assembly.

12. The puck system of claim 11, wherein said first puck pair and said second puck pair are included in a kit for mounting a pair of boot bindings of a rider.

13. A kit for mounting a pair of boot bindings on a snow gliding board, which comprises for each boot binding of said pair, a pair of puck assemblies for cooperatively mounting each boot binding, wherein each puck assembly of said pair comprises a sliderblock, a flanged disk, and a pair of fasteners, said sliderblocks having contralateral flange ledges, wherein said pair of puck assemblies are configured to cooperatively adjust stance orientation for each boot binding in three degrees of freedom including: a) pairwise boot placement adjustment relative to the nose end and tail end of the board, b) pairwise boot angulation optimal for the rider, and, c) pairwise crosswise centering for each boot relative to the edges of the board; and further comprising, an installation alignment tool configured to cooperatively orient said puck assemblies so that said flange ledges of said pair of puck assemblies are parallel as installed.

14. The kit of claim 13, wherein said installation alignment tool is further configured to cooperatively position said puck assemblies so that said sliderblocks are installed with a fixed separation distance.

15. The kit of claim 13, wherein said installation alignment tool is a full frame tool having a frame sized to engirdle said puck assemblies during installation.

16. The kit of claim 15, comprising instructions for using said full frame tool.

17. The kit of claim 13, wherein said installation alignment tool is a pocket sized installation alignment tool.

18. The kit of claim 16, comprising instructions for using said pocket sized installation alignment tool.

19. The kit of claim 13, further comprising a pair of boot bindings, each with a boot binding baseplate.

20. The kit of claim 19, wherein said baseplate and puck system in combination defines a ride mode interface having a torsional stiffness in the range of 70 to 130 inch-lb/degree when said baseplate is mounted on said puck assemblies.

21. The kit of claim 13, further comprising a snow gliding board, wherein said snow gliding board is selected from splitboard or snowboard.

22. An improved boot binding interface for splitboarding, which comprises:

a) a first puck and a second puck enabled to be fastened on a top surface of a board, each said puck having i) a flanged disk with cap plate and underside surface, said flanged disk having a mounting post on said underside surface, said mounting post having walls defining a slot extending therethrough, said slot for receiving a pair of threaded fasteners;

ii) a sliderblock with topside face, underside face, and two superiolateral parallel flanges contralaterally disposed thereon, a mounting channel between said flanges, said channel having a width and depth adapted to receive said flanged disk, and a cutout extending through said sliderblock in said mounting channel, wherein said cutout is enabled to receive said mounting post;

b) wherein said first puck and said second may be cooperatively rotated so that said contralateral parallel flanges are aligned for receiving a boot binding; and, c) further characterized in that said topside face of said sliderblock in said mounting channel comprises a plurality of offset circular grooves and said underside surface of said flanged disk comprises at least one detent ridge ring adapted to lockingly engage one of said plurality of offset circular grooves when tightened against said sliderblock member, said offset circular grooves enabling incremental adjustment of a separation distance between said first puck and said second puck, while independently enabling centerwise adjustment of a position of said pucks crosswise on a board and cooperative rotational angulation thereof.

23. A method for centering a ride mode interface toe-to-heel on a board, which comprises:

a) providing a toeside puck and a heelside puck, each said puck having a flanged disk mounted in a channel on top of a sliderblock, wherein a bottom surface of said flanged disk and a top surface of said channel comprise a plurality of engagement detents;

b) affixing said sliderblocks to a board by inserting said flanged disks thereon and fastening said flanged disks loosely to a board with at least two threaded fasteners;

c) cooperatively adjusting said sliderblocks on said flanged disks so as to center a boot binding crosswise toe-to-heel relative to a centerline of a board; and, d) tightening said at least two threaded fasteners to secure said sliderblocks when centered crosswise.

24. The method of claim 23, further comprising adjusting said sliderblocks on said flanged disks so as to define an end-to-end distance for securing a binding baseplate having a heel lock in locking contact with an outside end of said heel puck and a toe lock in contact with a toe end of said toe puck.

25. The method of claim 24, further comprising providing an installation alignment tool configured for cooperatively aligning and orienting said toeside puck and said heelside puck.

26. The method of claim 23, further comprising an installation alignment tool configured to for cooperatively spacing said toeside puck and said heelside puck.

27. A method for installing a boot binding on a snow gliding board, which comprises a means for adjusting a boot binding to be centered crosswise relative to a centerline on a snow gliding board.

* * * * *